US009894930B2

(12) United States Patent
Bonici et al.

(10) Patent No.: US 9,894,930 B2
(45) Date of Patent: Feb. 20, 2018

(54) SMOKING ARTICLE WITH AN AIRFLOW DIRECTING ELEMENT COMPRISING AN AEROSOL-MODIFYING AGENT

(71) Applicant: PHILIP MORRIS PRODUCTS S.A., Neuchatel (CH)

(72) Inventors: Alberto Bonici, Modena (IT); Anca Gabriela Haiduc, Orbe (CH); Daniele Sanna, Castel Maggiore (IT)

(73) Assignee: Philip Morris Products S.A., Neuchatel (CH)

( * ) Notice: Subject to any disclaimer, the term of this patent is extended or adjusted under 35 U.S.C. 154(b) by 66 days.

(21) Appl. No.: 14/654,689

(22) PCT Filed: Mar. 14, 2014

(86) PCT No.: PCT/EP2014/055098
§ 371 (c)(1),
(2) Date: Jun. 22, 2015

(87) PCT Pub. No.: WO2014/140273
PCT Pub. Date: Sep. 18, 2014

(65) Prior Publication Data

US 2015/0313281 A1 Nov. 5, 2015

(30) Foreign Application Priority Data

Mar. 15, 2013 (EP) ..... 13159642

(51) Int. Cl.
*A24F 47/00* (2006.01)
*A24D 1/00* (2006.01)

(52) U.S. Cl.
CPC ..... *A24F 47/006* (2013.01); *A24D 1/002* (2013.01); *A24F 47/004* (2013.01)

(58) Field of Classification Search
CPC ..... A24F 47/006
See application file for complete search history.

(56) References Cited

U.S. PATENT DOCUMENTS 4,848,374 A 7/1989 Chard et al.
4,938,236 A * 7/1990 Banerjee ..... A24F 47/006 131/194

(Continued)

FOREIGN PATENT DOCUMENTS

CN 88 1 00383 A 8/1988
CN 102946747 A 2/2013

(Continued)

OTHER PUBLICATIONS

International Search Report dated Sep. 5, 2014 in PCT/EP2014/055098 filed Mar. 14, 2014.

(Continued)

*Primary Examiner* — Alison L Hindenlang
*Assistant Examiner* — Jamel M Nelson
(74) *Attorney, Agent, or Firm* — Oblon, McClelland, Maier & Neustadt, L.L.P.

(57) ABSTRACT

There is provided a smoking article having a mouth end and a distal end, the smoking article including a combustible carbonaceous heat source; an aerosol-forming substrate; at least one air inlet downstream of the aerosol-forming substrate; an airflow pathway extending between the at least one air inlet and the mouth end of the smoking article; and an airflow directing element downstream of the aerosol-forming substrate. The airflow directing element defines a first portion of the airflow pathway extending from the at least one air inlet towards the aerosol-forming substrate and a second portion of the airflow pathway extending downstream from the first portion towards the mouth end of the smoking article. The airflow directing element includes an aerosol-modifying agent.

16 Claims, 3 Drawing Sheets

(56) References Cited

U.S. PATENT DOCUMENTS

| | | | | |
|---|---|---|---|---|
| 4,955,399 | A | 9/1990 | Potter et al. | |
| 5,040,551 | A | 8/1991 | Schlatter et al. | |
| 5,144,962 | A | 9/1992 | Counts et al. | |
| 5,392,792 | A * | 2/1995 | Banerjee | A24D 3/045 131/336 |
| 5,944,025 | A | 8/1999 | Cook et al. | |
| 6,164,287 | A * | 12/2000 | White | A24F 47/008 131/194 |
| 2004/0149296 | A1 | 8/2004 | Rostami et al. | |
| 2007/0102013 | A1 | 5/2007 | Adams et al. | |
| 2007/0215167 | A1 | 9/2007 | Llewellyn Crooks et al. | |
| 2009/0217933 | A1 | 9/2009 | Chen | |
| 2010/0186757 | A1* | 7/2010 | Crooks | A24F 47/006 131/58 |
| 2011/0271972 | A1 | 11/2011 | Thomas et al. | |

FOREIGN PATENT DOCUMENTS

| | | | |
|---|---|---|---|
| DE | 19935706 | A1 | 2/2001 |
| DE | 10 2007 026 979 | A1 | 4/2008 |
| EP | 0295122 | A2 | 12/1988 |
| EP | 0371285 | A2 | 6/1990 |
| EP | 0 430 559 | A2 | 6/1991 |
| WO | WO 99/63844 | A1 | 12/1999 |
| WO | WO 2007/042941 | A2 | 4/2007 |
| WO | WO 2009/022232 | A2 | 2/2009 |
| WO | WO 2009/074870 | A2 | 6/2009 |
| WO | 2013/120854 | A1 | 8/2013 |
| WO | 2014/096317 | A1 | 6/2014 |

OTHER PUBLICATIONS

Extended European Search Report dated Oct. 22, 2013 in Patent Application No. 13159642.1.

Combined Office Action and Search Report dated Jun. 22, 2017 in Chinese Patent Application No. 201480015580.X (with English translation).

* cited by examiner

SMOKING ARTICLE WITH AN AIRFLOW DIRECTING ELEMENT COMPRISING AN AEROSOL-MODIFYING AGENT

CROSS REFERENCE TO RELATED APPLICATION

This application is a U.S. national phase application under 35 U.S.C. § 371 of PCT/EP2014/055098, filed on Mar. 14, 2014, and claims the benefit of priority under 35 U.S.C. § 119 from prior EP Application No. 13159642.1, filed on Mar. 15, 2013, the entire contents of each of which are incorporated herein by reference.

The present invention relates to a smoking article comprising a combustible carbonaceous heat source and an aerosol-forming substrate.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located within, surrounding, or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of forced convective heating of the aerosol-forming substrate, at least one longitudinal airflow channel is provided through the combustible heat source.

In known heated smoking articles in which heat transfer from the heat source to the aerosol-forming substrate occurs primarily by forced convection, the convective heat transfer and hence the temperature in the aerosol-forming substrate can vary considerably depending upon the puffing behaviour of the user. As a result, the composition and hence the sensory properties of the mainstream aerosol inhaled by the user may be disadvantageously highly sensitive to a user's puffing regime.

In known heated smoking articles in which air drawn through the heated smoking article comes into direct contact with a combustible heat source of the heated smoking article, puffing by a user results in activation of combustion of the combustible heat source. Intense puffing regimes may therefore lead to sufficiently high convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate.

The levels of undesirable pyrolytic and combustion by-products in the mainstream aerosols generated by such known heated smoking articles may also disadvantageously vary significantly depending upon the particular puffing regime adopted by the user.

There remains a need for a heated smoking article comprising a heat source and an aerosol-forming substrate downstream of the heat source in which spikes in the temperature of the aerosol-forming substrate are avoided under intense puffing regimes. In particular, there remains a need for a heated smoking article comprising a heat source and an aerosol-forming substrate downstream of the heat source in which substantially no combustion or pyrolysis of the aerosol-forming substrate occurs under intense puffing regimes.

It is known to provide conventional cigarettes, and other smoking articles in which tobacco is combusted, with filters comprising flavorants and other aerosol-modifying agents. However, mouthpieces for heated smoking articles are typically shorter than filters for conventional cigarettes and other smoking articles in which tobacco is combusted. In addition, since it is heated rather than combusted, the quantity of tobacco or other aerosol-forming substrate in heated smoking articles is typically less than the quantity of tobacco in conventional cigarette and other smoking articles in which the tobacco is combusted. As a result, the maximum possible loading of aerosol-modifying agent in the mouthpiece and aerosol-forming substrate of a heated smoking may be lower than the maximum possible loading of aerosol-modifying agent in the filter and tobacco of a conventional cigarette.

It would be desirable to provide a heated smoking article in which the strength and consistency of aerosol-modifying agent delivered to a user is improved.

According to the invention there is provided a smoking article having a mouth end and a distal end, the smoking article comprising: a combustible carbonaceous heat source; an aerosol-forming substrate; at least one air inlet downstream of the aerosol-forming substrate; an airflow pathway extending between the at least one air inlet and the mouth end of the smoking article; and an airflow directing element downstream of the aerosol-forming substrate. The airflow directing element defines a first portion of the airflow pathway extending longitudinally upstream from the at least one air inlet towards the aerosol-forming substrate and a second portion of the airflow pathway extending longitudinally downstream from the first portion towards the mouth end of the smoking article. The airflow directing element comprises an aerosol-modifying agent.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term 'airflow pathway' is used to describe a route along which air may be drawn through the smoking article for inhalation by a user.

As used herein, the terms 'upstream', 'downstream', 'proximal', 'distal', 'front' and 'rear', are used to describe the relative positions of components, or portions of components, of the smoking article in relation to the direction in which a user draws on the smoking article during use thereof.

The smoking article comprises a mouth end through which in use an aerosol exits the smoking article and is delivered to a user. The mouth end may also be referred to as the proximal end. In use, a user draws on the proximal or mouth end of the smoking article in order to inhale an aerosol generated by the smoking article. The smoking article comprises a distal end opposed to the proximal or mouth end. The proximal or mouth end of the smoking article may also be referred to as the downstream end and the distal end of the smoking article may also be referred to as the upstream end. Components, or portions of components, of the smoking article may be described as being upstream or downstream of one another based on their relative positions between the proximal, downstream or mouth end and the distal or upstream end of the smoking article.

In use, a user draws on the proximal, downstream or mouth end of the smoking article. The mouth end is downstream of the distal end. The heat source is located at or proximate to the distal end of the smoking article. The aerosol-forming substrate is preferably downstream of the heat source.

As used herein, the term 'aerosol-modifying agent' is used to describe any agent that, in use, modifies one or more features or properties of an aerosol generated by the aerosol-forming substrate of the smoking article.

In use, air is drawn into the first portion of the airflow pathway through the at least one air inlet. The drawn air passes through the first portion of the airflow pathway towards the aerosol-forming substrate and then downstream towards the mouth end of the smoking article through the second portion of the airflow pathway. The aerosol-modifying agent is entrained in the drawn air as it passes along one or both of the first portion and the second portion of the airflow pathway defined by the airflow directing element.

During puffing by a user, cool air drawn through the at least one air inlet downstream of the aerosol-forming substrate and through the first portion of the airflow pathway towards the aerosol-forming substrate advantageously reduces the temperature of the aerosol-forming substrate of smoking articles according to the invention. This substantially prevents or inhibits spikes in the temperature of the aerosol-forming substrate during puffing by a user.

As used herein, the term 'cool air' is used to describe ambient air that is not significantly heated by the heat source upon puffing by a user.

By preventing or inhibiting spikes in the temperature of the aerosol-forming substrate, the inclusion of airflow directing element that defines a first portion of the airflow pathway extending from the at least one air inlet towards the aerosol-forming substrate and a second portion of the airflow pathway extending downstream from the aerosol-forming substrate towards the mouth end of the smoking article, advantageously helps to avoid or reduce combustion or pyrolysis of the aerosol-forming substrate of the smoking articles according to the invention under intense puffing regimes. In addition, the inclusion of such an airflow pathway advantageously helps to minimise or reduce the impact of a user's puffing regime on the composition of the mainstream aerosol of smoking articles according to the invention.

As stated above, the aerosol-modifying agent may be any agent that, in use, is entrained in air drawn through the smoking article for inhalation by a user as it passes along one or both of the first portion and the second portion of the airflow pathway defined by the airflow directing element and that modifies one or more features or properties of an aerosol generated by the aerosol-forming substrate of the smoking article.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

The aerosol directing element may comprise an aerosol-modifying agent that is both a flavourant and a chemesthetic agent. For example, the aerosol directing element may comprise menthol or another flavourant that provides a cooling chemesthetic effect.

The aerosol directing element may comprise a combination of two or more different aerosol-modifying agents.

Preferably, the airflow directing element comprises a flavourant. The airflow directing element may comprise any flavourant capable of releasing one or both of a flavour or aroma into air drawn along one or both of the first portion and the second portion of the airflow pathway defined by the airflow directing element.

The aerosol directing element may comprise any suitable quantity of aerosol-modifying agent. In one preferred embodiment of the invention, the aerosol directing element comprises about 1.5 mg of more of a flavourant.

The airflow directing element may comprise two or more flavourants of the same or different types. For example, the airflow directing element may comprise one or more natural flavourants or one or more synthetic flavourants or a combination of one or more natural flavourants and one or more synthetic flavourants.

Suitable natural flavourants are well known in the art and include, but are not limited to: essential oils (for example, cinnamon essential oil, clove essential oil or eugenol, *eucalyptus* essential oil, peppermint essential oil, spearmint essential oil and wintergreen essential oil); oleoresins (for example, ginger oleoresin and clove oleoresin); absolutes (for example, cocoa absolute); fruit concentrates; botanical and fruit extracts (for example, blueberry extract, cherry extract, coffee extract, cranberry extract, geranium extract, green tea extract, orange extract, lemon extract, tobacco extract and vanilla extract); and combinations thereof.

Suitable synthetic flavourants are also well known in the art and include, but are not limited to: synthetic menthol; synthetic vanillin and combinations thereof.

In a particularly preferred embodiment of the invention, the aerosol directing element comprises menthol. As used herein, the term 'menthol' denotes the compound 2-isopropyl-5-methylcyclohexanol in any of its isomeric forms.

The aerosol directing element may comprise a solid aerosol-modifying agent or a liquid aerosol-modifying agent. In particularly preferred embodiments of the invention, the aerosol directing element comprises one or both of solid menthol and liquid menthol.

The aerosol directing element may comprise a plurality of solid particles of an aerosol-modifying agent. As used herein, the term 'particles' is used to describe granular and particulate solid materials having any suitable form including, but not limited to, powders, crystals, granules, needles, flakes, pellets, and beads. For example, the aerosol directing element may comprise a plurality of solid menthol particles. As used herein, the term 'solid menthol particles' is used to describe any granular or particulate solid material comprising at least about 80% menthol by weight.

Alternatively or in addition, the aerosol directing element may comprise a plurality of capsules comprising a solid outer shell and an inner core comprising a liquid aerosol-modifying agent. For example, the aerosol directing element may comprise a plurality of capsules comprising a solid outer shell and an inner core comprising liquid menthol.

The aerosol-modifying agent may be a volatile liquid. As used herein, the term 'volatile' is used to describe a liquid having a vapour pressure of at least about 20 Pa. Unless otherwise stated, all vapour pressures referred to herein are vapour pressures at 25° C. measured in accordance with ASTM E1194-07.

The aerosol-modifying agent may comprise an aqueous solution of one or more compounds. Alternatively the aerosol-modifying agent may comprise a non-aqueous solution of one or more compounds.

The aerosol-modifying agent may comprise a mixture of two or more different volatile liquid compounds.

Alternatively, the aerosol-modifying agent may comprise one or more non-volatile compounds and one or more volatile compounds. For example, the aerosol-modifying agent may comprise a solution of one or more non-volatile compounds in a volatile solvent or a mixture of one or more non-volatile liquid compounds and one or more volatile liquid compounds.

The aerosol-modifying agent may be located in the first portion of the airflow pathway defined by the airflow directing element. Alternatively or in addition the aerosol-modifying agent may be located in the second portion of the airflow pathway.

Where the aerosol-modifying agent is located along the first portion of the airflow pathway, the aerosol-modifying agent is entrained in air drawn through the smoking article for inhalation by a user prior to the drawn air passing through the aerosol-forming substrate of the smoking article.

Where the aerosol-modifying agent is located along the second portion of the airflow pathway, the aerosol-modifying agent is entrained in air drawn through the smoking article for inhalation by a user after the drawn air passes through the aerosol-forming substrate of the smoking article.

The aerosol-modifying agent may be located along substantially the entire length of the first portion of the airflow pathway defined by the airflow directing element. Alternatively, the aerosol-modifying agent may be located along only a portion of the length of the first portion of the airflow pathway defined by the airflow directing element.

The aerosol-modifying agent may be located along substantially the entire length of the second portion of the airflow pathway defined by the airflow directing element. Alternatively, the aerosol-modifying agent may be located along only a portion of the length of the second portion of the airflow pathway defined by the airflow directing element.

As used herein, the term 'length' is used to describe the dimension in the longitudinal direction of the smoking article between the distal or upstream end and the proximal or downstream end.

The airflow directing element may comprise a substrate comprising an aerosol-modifying agent located in the first portion of the airflow pathway defined by the airflow directing element. Alternatively or in addition, the airflow directing element may comprise a substrate comprising an aerosol-modifying agent located in the second portion of the airflow pathway defined by the airflow directing element.

The aerosol-modifying agent may be applied to the substrate by, for example, coating, dipping, injecting, painting or spraying the substrate with the aerosol-modifying agent.

The substrate may be a porous sorption element. The aerosol-modifying agent may be adsorbed on the surface of the porous sorption element, or absorbed in the porous sorption element, or both adsorbed on and absorbed in the porous sorption element.

Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

In certain embodiments, the substrate is a non-laminar substrate. In certain preferred embodiments, the substrate is a non-laminar fibrous substrate. In certain particularly preferred embodiments, the non-laminar fibrous substrate is a thread. As used herein, the term 'thread' is used to describe any elongate non-laminar substrate. For example, the non-laminar substrate may be a thread formed from one or more twisted cotton fibres or one or more twisted, laminar strips of paper.

Preferably, the longitudinal axis of the non-laminar fibrous substrate is disposed substantially parallel to the longitudinal axis of the smoking article.

Preferably, the first portion of the airflow pathway defined by the airflow directing element extends from the at least one air inlet to at least proximate the aerosol-forming substrate. More preferably, the first portion of the airflow pathway extends from the at least one air inlet to the aerosol-forming substrate.

The second portion of the airflow pathway extends downstream from the aerosol-forming substrate towards the mouth end of the smoking article.

In certain embodiments, the second portion of the airflow pathway may extend downstream from within the aerosol-forming substrate towards the mouth end of the smoking article.

In one preferred embodiment, the first portion of the airflow pathway defined by the airflow directing element extends from the at least one air inlet to the aerosol-forming substrate and the second portion of the airflow pathway defined by the airflow directing element extends downstream from the aerosol-forming substrate towards the mouth end of the smoking article.

In another preferred embodiment, the first portion of the airflow pathway defined by the airflow directing element extends upstream from the at least one air inlet to the aerosol-forming substrate and the second portion of the airflow pathway defined by the airflow directing element extends Idownstream from within the aerosol-forming substrate towards the mouth end of the smoking article.

In use, an aerosol is generated by the transfer of heat from the heat source to the aerosol-forming substrate of smoking articles according to the invention. By adjusting the position of the upstream end of the second portion of the airflow pathway defined by the airflow directing element relative to the aerosol-forming substrate, it is possible to control the location at which the aerosol exits the aerosol-forming substrate. This advantageously allows smoking articles according to the invention to be produced having desired aerosol deliveries.

In preferred embodiments, air drawn into the first portion of the airflow pathway through the at least one air inlet passes through the first portion of the airflow pathway to the aerosol-forming substrate, through the aerosol-forming substrate and then downstream towards the mouth end of the smoking article through the second portion of the airflow pathway.

In one preferred embodiment, the first portion of the airflow pathway and the second portion of the airflow pathway are concentric. However, it will be appreciated that in other embodiments the first portion of the airflow pathway and the second portion of the airflow pathway may be non-concentric. For example, the first portion of the airflow pathway and the second portion of the airflow pathway may be parallel and non-concentric.

Where the first portion of the airflow pathway and the second portion of the airflow pathway are concentric, preferably the first portion of the airflow pathway surrounds the second portion of the airflow pathway. However, it will be appreciated that in other embodiments the second portion of the airflow pathway may surround the first portion of the airflow pathway.

In one particularly preferred embodiment the first portion of the airflow pathway and the second portion of the airflow pathway are concentric, the second portion of the airflow pathway is disposed substantially centrally within the smoking article and the first portion of the airflow pathway surrounds the second portion of the airflow pathway. This arrangement is particularly advantageous in embodiments where the aerosol-forming substrate is downstream of the heat source and, as described further below, the smoking article according to the invention further comprises a heat-conducting element around and in direct contact with a rear portion of the heat source and an adjacent front portion of the aerosol-forming substrate.

The first portion of the airflow pathway and the second portion of the airflow pathway may be of substantially constant transverse cross-section. For example, where the first portion of the airflow pathway and the second portion of the airflow pathway are concentric, one of the first portion of the airflow pathway and the second portion of the airflow pathway may be of substantially constant circular cross-section and the other of the first portion of the airflow pathway and the second portion of the airflow pathway may be of substantially constant annular cross-section.

Alternatively, one or both of the first portion of the airflow pathway and the second portion of the airflow pathway may be of non-constant cross-section. For example, the first portion of the airflow pathway may be tapered such that the transverse cross-section of the first portion of the airflow pathway increases or decreases as the first portion of the airflow pathway extends towards to aerosol-forming substrate. Alternatively or in addition, the second portion of the airflow pathway may be tapered such that the transverse cross-section of the second portion of the airflow pathway increases or decreases as the second portion of the airflow pathway extends downstream towards the mouth end of the smoking article.

In one preferred embodiment, the transverse cross-section of the first portion of the airflow pathway increases as the first portion of the airflow pathway extends towards to aerosol-forming substrate and the transverse cross-section of the second portion of the airflow pathway increases as the second portion of the airflow pathway extends downstream towards the mouth end of the smoking article.

Preferably, smoking articles according to the invention comprise an outer wrapper that circumscribes the aerosol-forming substrate, the aerosol directing element and any other components of the smoking article downstream of the aerosol-directing element. In embodiments where the aerosol-forming substrate is downstream of the heat source, the outer wrapper preferably circumscribes at least a rear portion of the heat source. Preferably, the outer wrapper is substantially air impermeable. Smoking articles according to the invention may comprise outer wrappers formed from any suitable material or combination of materials. Suitable materials are well known in the art and include, but are not limited to, cigarette paper and tipping paper. The outer wrapper should tightly wrap the heat source, aerosol-forming substrate and aerosol directing element of the smoking article when the smoking article is assembled.

The at least one air inlet downstream of the aerosol-forming substrate for drawing air into the first portion of the airflow pathway is provided in the outer wrapper and any other materials circumscribing components or portions of components of smoking articles according to the invention through which air may be drawn into the first portion of the airflow pathway. As used herein, the term 'air inlet' is used to describe one or more holes, slits, slots or other apertures in the outer wrapper and any other materials circumscribing components or portions of components of smoking articles according to the invention downstream of the aerosol-forming substrate through which air may be drawn into the first portion of the airflow pathway.

The number, shape, size and location of the air inlets may be appropriately adjusted to achieve a good smoking performance.

The at least one air inlet is provided between a downstream end of the aerosol-forming substrate and a downstream end of the airflow directing element.

In certain embodiments, the smoking article may comprise a plurality of rows of air inlets, each row comprising a plurality of air inlets. In such embodiments the rows preferably circumscribe the airflow directing element and are longitudinally spaced apart from one another along the length of the airflow directing element. The rows of air inlets may be longitudinally spaced apart by between about 0.5 mm and about 5.0 mm along the length of the airflow directing element. Preferably the rows of air inlets are longitudinally spaced apart by about 1.0 mm along the length of the airflow directing element.

The airflow directing element may abut the aerosol-forming substrate. Alternatively, the airflow directing element may extend into the aerosol-forming substrate. For example, in certain embodiments the airflow directing element may extend a distance of up to 0.5 L into the aerosol-forming substrate, where L is the length of the aerosol-forming substrate.

The airflow directing element may have a length of between about 7 mm and about 50 mm, for example a length of between about 10 mm and about 45 mm or of between about 15 mm and about 30 mm. The airflow directing element may have other lengths depending upon the desired overall length of the smoking article, and the presence and length of other components within the smoking article.

In certain embodiments, the at least one air inlet is between about 2 mm and about 5 mm from the upstream end of the airflow directing element, and the length of the airflow directing element is between about 20 mm and about 50 mm.

In certain preferred embodiments, the at least one air inlet is about 5 mm from the upstream end of the airflow directing element, and the length of the airflow directing element is between about 26 mm and about 28 mm.

Surprisingly, it has been found that positioning the at least one air inlet too close to the upstream end of the airflow directing element may be disadvantageous. The air inlet helps to depressurize the build up of volatile compounds released from the aerosol-forming substrate as a result of heat transfer from the heat source. Placing the at least one air inlet too close to the upstream end of the airflow directing element may allow sidestream aerosol to escape through the at least one air inlet, which may be undesirable. For this reason, in certain embodiments it may be undesirable to place the at least one air inlet less than about 2 mm from the upstream end of the airflow directing element.

The airflow directing element may comprise an open-ended, substantially air impermeable hollow body. In such embodiments, the exterior of the open-ended, substantially air impermeable hollow body defines one of the first portion of the airflow pathway and the second portion of the airflow pathway and the interior of the open-ended, substantially air impermeable hollow body defines the other of the first portion of the airflow pathway and the second portion of the airflow pathway.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

Preferably, the exterior of the open-ended, substantially air impermeable hollow body defines the first portion of the airflow pathway and the interior of the open-ended, substantially air impermeable hollow body defines the second portion of the airflow pathway.

The open-ended, substantially air impermeable hollow body may comprise the aerosol-modifying agent. For example, the aerosol-modifying agent may be applied one or both of the exterior and the interior of the open-ended, substantially air impermeable hollow body.

The aerosol-modifying agent may be applied to one or more materials from which the open-ended, substantially air impermeable hollow body is formed prior to formation of the open-ended, substantially air impermeable hollow body. Alternatively or in addition, the aerosol-modifying agent may be applied to the open-ended, substantially air impermeable hollow body during formation of the open-ended, substantially air impermeable hollow body. Alternatively or in addition, the aerosol-modifying agent may be applied to the open-ended, substantially air impermeable hollow body after formation of the open-ended, substantially air impermeable hollow body.

The aerosol-modifying agent may be applied to the open-ended, substantially air impermeable hollow body by, for example, coating, painting, or spraying one or both of the exterior and the interior of the open-ended, substantially air impermeable hollow body with the aerosol-modifying agent.

Alternatively or in addition, the airflow directing element may comprise a substrate comprising an aerosol-modifying agent located in the open-ended, substantially air impermeable hollow body.

The aerosol-modifying agent may be applied to the substrate by, for example, coating, dipping, injecting, painting or spraying the substrate with the aerosol-modifying agent.

The substrate may be a porous sorption element. Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

In certain preferred embodiments, the substrate is a non-laminar fibrous substrate. In certain particularly preferred embodiments, the non-laminar fibrous substrate is a thread.

Preferably, the longitudinal axis of the non-laminar fibrous substrate is disposed substantially parallel to the longitudinal axis of the smoking article.

The transverse cross-section of the substantially air impermeable hollow body may be of any suitable shape including, but not limited to, circular, oval, square, triangular, and rectangular.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 mm and about 50 mm, for example a length of between about 10 mm and about 45 mm or between about 15 mm and about 30 mm. The open-ended, substantially air impermeable hollow body may have other lengths depending upon the desired overall length of the smoking article, and the presence and length of other components within the smoking article.

Where the open-ended, substantially air impermeable hollow body is a cylinder, the cylinder may have a diameter of between about 2 mm and about 5 mm, for example a diameter of between about 2.5 mm and about 4.5 mm. The cylinder may have other diameters depending upon the desired overall diameter of the smoking article.

Where the open-ended, substantially air impermeable hollow body is a truncated cone, the upstream end of the truncated cone may have a diameter of between about 2 mm and about 5 mm, for example a diameter of between about 2.5 mm and about 4.5 mm. The upstream end of the truncated cone may have other diameters depending upon the desired overall diameter of the smoking article Where the open-ended, substantially air impermeable hollow body is a truncated cone, the downstream end of the truncated cone may have a diameter of between about 5 mm and about 9 mm, for example of between about 7 mm and about 8 mm. The downstream end of the truncated cone may have other diameters depending upon the desired overall diameter of the smoking article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5 L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

In certain embodiments where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the at least one air inlet. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the heat source to the aerosol-forming substrate. Suitable air permeable materials are known in the art and include, but are not limited to, porous materials such as, for example, cellulose acetate tow, cotton, open-cell ceramic and polymer foams, paper, tobacco material, porous ceramic elements, porous plastics elements, porous carbon elements, porous metallic elements and combinations thereof. In certain preferred embodiments, the air permeable diffuser comprises a substantially homogeneous, air permeable porous material.

The air permeable diffuser may comprise the aerosol-modifying agent. The aerosol-modifying agent may be applied to the air permeable diffuser by, for example, coating, dipping, injecting, painting or spraying the air permeable diffuser with the aerosol-modifying agent.

The aerosol-modifying agent may be applied to one or more suitable air permeable materials from which the air permeable diffuser is formed prior to formation of the air permeable diffuser. Alternatively or in addition, the aerosol-modifying agent may be applied to the air permeable diffuser during formation of the air permeable diffuser. Alternatively or in addition, the aerosol-modifying agent may be applied to the air permeable diffuser after formation of the air permeable diffuser.

Alternatively or in addition, the airflow directing element may comprise a substrate comprising an aerosol-modifying agent located in the air permeable diffuser.

The aerosol-modifying agent may be applied to the substrate by, for example, coating, dipping, injecting, painting or spraying the substrate with the aerosol-modifying agent.

The substrate may be a porous sorption element. Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

In certain embodiments, the substantially air impermeable hollow body may be circumscribed by an air permeable diffuser and a substantially air impermeable seal. In such embodiments, the substantially air impermeable seal is located downstream of the air permeable diffuser and the at least one air inlet. The substantially air impermeable seal may be of substantially the same diameter as the aerosol-forming substrate. For example, in some embodiments an upstream end of the substantially air impermeable hollow body may be circumscribed by an air permeable diffuser and a downstream end of the substantially air impermeable hollow body may be circumscribed by a substantially impermeable plug or washer of substantially the same diameter as the aerosol-forming substrate.

In other embodiments, the substantially air impermeable hollow body may be circumscribed by an air permeable diffuser comprising a low resistance-to-draw portion extending from proximate to the at least one air inlet to an upstream end of the air permeable diffuser and a high resistance-to-draw portion extending from proximate to the at least one air inlet to a downstream end of the air permeable diffuser.

In such embodiments, the resistance-to-draw portion of the high resistance-to-draw portion of the air permeable diffuser is greater than resistance-to-draw of the low resistance-to-draw portion of the air permeable diffuser. In other words, the resistance-to-draw between the at least one air inlet and the downstream end of the air-permeable segment is greater than the resistance-to-draw between the upstream end of the air-permeable segment and the at least one air inlet. The first portion of the airflow pathway is defined by the low resistance-to-draw portion of the air permeable diffuser.

The difference between the resistance-to-draw of the high resistance-to-draw portion and the low resistance-to-draw portion of the air permeable diffuser is such that in use at least a portion of the air drawn through the at least one air inlet flows along the first portion of the airflow pathway, through the low resistance-to-draw portion of the air-permeable segment, towards the aerosol-forming substrate. The difference between the resistance-to-draw of the high resistance-to-draw portion and the low resistance-to-draw portion of the air permeable diffuser is preferably such that, in use, the majority of the air drawn through the at least one air inlet flows along the first portion of the airflow pathway, through the low resistance-to-draw portion of the air-permeable segment, towards the aerosol-forming substrate.

The ratio of the resistance-to-draw between the high resistance-to-draw portion and the low resistance-to-draw portion is greater than 1:1 and less than or equal to about 50:1. Preferably, the ratio of the resistance-to-draw is between about 2:1 and about 50:1, more preferably between about 4:1 and about 50:1, most preferably between about 8:1 and about 12:1. A ratio of about 10:1 has been found to be particularly advantageous.

The high resistance-to-draw portion and the low resistance-to-draw portion of the air permeable diffuser both have a finite resistance-to-draw. That is the high resistance-to-draw portion and the low resistance-to-draw portion of the air permeable diffuser are not blocked, plugged or sealed in a way to completely obstruct air from passing through the air permeable diffuser. Manufacturing the air permeable diffuser without any such block, plug or seal may advantageously reduce manufacturing complexity.

The resistance-to-draw of the high resistance-to-draw portion and the low resistance-to-draw portion of the air permeable diffuser may be measured in accordance with ISO 6565:2011 and is typically expressed in units of $mmH_2O$. The resistance-to-draw of the air permeable diffuser may be measured by drawing on one end of the airflow directing element while the second portion of the airflow pathway is sealed such that air flows only through the air permeable diffuser of the airflow directing element.

In certain preferred embodiments, the resistance-to-draw of the air permeable diffuser is homogenous along its length. In such embodiments, the resistance-to-draw of the high resistance-to-draw portion and the low resistance-to-draw portion of the air permeable diffuser are proportional to their respective lengths. In such embodiments, the at least one air inlet is located towards the upstream end of the airflow directing element. In this way, the resistance-to-draw of the low resistance-to-draw portion of the air permeable diffuser upstream of the at least one air inlet will be lower than the resistance-to-draw of the high resistance-to draw-portion of the air permeable diffuser downstream of the at least one air inlet.

In other embodiments the resistance-to-draw of the air permeable diffuser is not homogeneous along its length. In such embodiments, the resistance-to-draw of the low resistance-to-draw portion of the air permeable diffuser may be measured by transversely cutting the airflow directing element at a location corresponding to the at least one air inlet closest to the upstream end of the air permeable diffuser to separate the low resistance-to-draw portion of the air permeable diffuser from the remainder of the air permeable diffuser, and drawing on one end of the cut low resistance-to-draw portion while sealing the second portion of the air flow pathway such that air flows only through the low resistance-to-draw portion of the air permeable diffuser. Similarly, the resistance-to-draw of the high resistance-to-draw portion of the air-permeable segment may be measured by transversely cutting the airflow directing element at a location corresponding to the at least one air inlet closest to the downstream end of the air permeable diffuser to separate the high resistance-to-draw portion of the air permeable diffuser from the remainder of the air permeable diffuser, and drawing on one end of the cut high resistance-to-draw portion while sealing the second portion of the air flow pathway such that air flows only through the high resistance-to-draw portion of the air permeable diffuser.

In embodiments where the smoking article comprises a plurality of longitudinally spaced apart rows of air inlets, the low resistance-to-draw portion of the air permeable diffuser extends from the row of air inlets closest to the upstream end of the air permeable diffuser to the upstream end of the air-permeable segment, and the high resistance-to-draw portion of the air permeable diffuser extends from the row of air inlets closest to the downstream end of the air permeable diffuser to the downstream end of the air permeable diffuser. Thus, in such embodiments the portion of the air-permeable segment between the rows of air inlets is not incorporated into the measurement of the resistance-to-draw of either the high resistance-to-draw portion or the high resistance-to-draw portion of the air permeable diffuser.

In certain preferred embodiments, the air permeable diffuser comprises substantially uniformly distributed cellulose acetate tow and the resistance-to-draw of the air permeable diffuser is homogenous along its length.

In alternative embodiments, the air permeable diffuser comprises non-uniformly distributed cellulose acetate tow and the resistance-to-draw of the air permeable diffuser is not homogeneous along its length. In such embodiments, the density of the non-uniformly distributed cellulose acetate tow is used to control the difference in resistance-to-draw between the high resistance-to-draw portion and the low resistance-to-draw portion of the air permeable diffuser.

In further embodiments, the air permeable diffuser comprises crimped paper. having a first region extending from the at least one air inlet towards the upstream end of the air permeable diffuser, corresponding to at least a part of the low resistance-to-draw portion of the air permeable diffuser, and a second region extending from the at least one air inlet towards the downstream end of the air permeable diffuser, corresponding to at least a part of the high resistance-to-draw portion of the air permeable diffuser.

Preferably, the first region of the crimped paper extends from the at least one air inlet to the upstream end of the air permeable diffuser and the second region of the crimped paper extends from the at least one air inlet to the downstream end of the air-permeable segment. In such embodiments, the first region of the crimped paper has a lower resistance-to-draw than the second region of the crimped paper.

The crimped paper may have a third region extending from the second region to the downstream end of the air-permeable segment. In such embodiments, the combined resistance-to-draw of the second region and the third region of the crimped paper is greater than the resistance to draw of the first region of the crimped paper. In certain embodiments, the third region of the crimped paper has substantially the same resistance-to-draw as the first region of the crimped paper.

Preferably, the resistance to draw of the first portion of the crimped paper is between about 6 mm $H_2O$ and about 10 mm $H_2O$ per mm length, and the resistance to draw of the second portion and, where present, the third portion of the crimped paper is between about 10 mm $H_2O$ to about 18 mm $H_2O$ per mm length. In a particularly preferred embodiment, the resistance to draw of the portion of the air permeable diffuser upstream of the at least one air inlet is about 10 mm $H_2O$ and the resistance to draw of the portion of the air permeable diffuser downstream of the at least one air inlet is about 20 mm $H_2O$.

The high resistance-to-draw portion of the air permeable diffuser may have a reduced airflow cross-section compared to the low resistance-to-draw portion of the air permeable diffuser. As used herein, the term 'airflow cross-section' describes the cross-sectional portion of the air-permeable segment through which air may flow.

Reducing the cross-section of at least a part of the high resistance draw portion of the air permeable diffuser may be one or an additional way to increase the resistance-to-draw of the high resistance-to-draw portion of the air permeable diffuser relative to the low resistance-to-draw portion of the air permeable diffuser. In such embodiments, the air permeable diffuser may comprise an air impermeable material to reduce the airflow cross-section of at least a part of the high resistance-to-draw portion of the air permeable diffuser. Suitable air impermeable materials include, but are not limited to, hot melt glues, silicone, and impermeable plastics. For example, a layer of hot melt glue may be applied to a region within the high resistance-to-draw portion of the air permeable diffuser to narrow the airflow cross-section of the high resistance-to-draw portion of the air permeable diffuser.

In one preferred embodiment, the airflow directing element comprises an open ended, substantially air impermeable, hollow tube of reduced diameter compared to the aerosol-forming substrate and an annular substantially air impermeable seal of substantially the same outer diameter as the aerosol-forming substrate, which circumscribes the hollow tube downstream of the at least one air inlet.

In this embodiment, the volume bounded radially by the exterior of the hollow tube and an outer wrapper of the smoking article defines the first portion of the airflow pathway that extends from the at least one air inlet towards the aerosol-forming substrate and the volume bounded radially by the interior of the hollow tube defines the second portion of the airflow pathway that extends downstream towards the mouth end of the smoking article.

The airflow directing element may further comprise an inner wrapper, which circumscribes the hollow tube and the annular substantially air impermeable seal.

In this embodiment, the volume bounded radially by the exterior of the hollow tube and the inner wrapper of the airflow directing element defines the first portion of the airflow pathway that extends from the at least one air inlet towards the aerosol-forming substrate and the volume bounded by the interior of the hollow tube defines the second portion of the airflow pathway that extends downstream towards the mouth end of the smoking article.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

Where the airflow directing element further comprises an inner wrapper, the inner wrapper may circumscribe the hollow tube, the annular substantially air impermeable seal and the annular air permeable diffuser.

In use, when a user draws on the mouth end of the smoking article, cool air is drawn into the smoking article through the at least one air inlet downstream of the aerosol-forming substrate. The drawn air passes to the aerosol-forming substrate along the first portion of the airflow pathway between the exterior of the hollow tube and the outer wrapper of the smoking article or inner wrapper of the airflow directing element. The drawn air passes through the aerosol-forming substrate and then passes downstream along the second portion of the airflow pathway through the interior of the hollow tube towards the mouth end of the smoking article for inhalation by the user. The airflow directing element comprises an aerosol-modifying agent, which is entrained in the drawn air as it passes along one or both of the first portion and the second portion of the airflow pathway.

Where the airflow directing element comprises an annular air permeable diffuser, the drawn air passes through the annular air permeable diffuser as it passes along the first portion of the airflow pathway towards the aerosol-forming substrate.

In another preferred embodiment, the airflow directing element comprises an open ended, substantially air impermeable, hollow tube of reduced diameter compared to the aerosol-forming substrate and an annular air permeable diffuser of substantially the same outer diameter as the aerosol-forming substrate, which circumscribes the hollow tube upstream. For example, the hollow tube may be embedded in a plug of cellulose acetate tow. The annular air permeable diffuser comprises a low resistance-to-draw portion extending from proximate to the at least one air inlet to an upstream end of the air permeable diffuser and a high resistance-to-draw portion extending from proximate to the at least one air inlet to a downstream end of the air permeable diffuser.

In this embodiment, the volume bounded radially by the exterior of the hollow tube and an outer wrapper of the smoking article defines the first portion of the airflow pathway that extends from the at least one air inlet towards the aerosol-forming substrate and the volume bounded radially by the interior of the hollow tube defines the second portion of the airflow pathway that extends downstream towards the mouth end of the smoking article.

The airflow directing element may further comprise an inner wrapper, which circumscribes the hollow tube and the annular annular air permeable diffuser.

In this embodiment, the volume bounded radially by the exterior of the hollow tube and the inner wrapper of the airflow directing element defines the first portion of the airflow pathway that extends from the at least one air inlet towards the aerosol-forming substrate and the volume bounded by the interior of the hollow tube defines the second portion of the airflow pathway that extends downstream towards the mouth end of the smoking article.

The open upstream end of the hollow tube may abut a downstream end of the aerosol-forming substrate. Alternatively, the open upstream end of the hollow tube may be inserted or otherwise extend into the downstream end of the aerosol-forming substrate.

In use, when a user draws on the mouth end of the smoking article, cool air is drawn into the smoking article through the at least one air inlet downstream of the aerosol-forming substrate. The drawn air passes to the aerosol-forming substrate through the low resistance-to-draw portion of the annular air permeable diffuser along the first portion of the airflow pathway between the exterior of the hollow tube and the outer wrapper of the smoking article or inner wrapper of the airflow directing element. The drawn air passes through the aerosol-forming substrate and then passes downstream along the second portion of the airflow pathway through the interior of the hollow tube towards the mouth end of the smoking article for inhalation by the user. The airflow directing element comprises an aerosol-modifying agent, which is entrained in the drawn air as it passes along one or both of the first portion and the second portion of the airflow pathway.

In another preferred embodiment, the airflow directing element comprises an open ended, substantially air impermeable, truncated hollow cone having an upstream end of reduced diameter compared to the aerosol-forming substrate and a downstream end of substantially the same diameter as the aerosol-forming substrate.

In this embodiment, the volume bounded radially by the exterior of the truncated hollow cone and an outer wrapper of the smoking article defines the first portion of the airflow pathway that extends from the at least one air inlet towards the aerosol-forming substrate and the volume bounded radially by the interior of the truncated hollow cone defines the second portion of the airflow pathway that extends towards the mouth end of the smoking article.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

In use, when a user draws on the mouth end of the smoking article, cool air is drawn into the smoking article through the at least one air inlet downstream of the aerosol-forming substrate. The drawn air passes to the aerosol-forming substrate along the first portion of the airflow pathway between the outer wrapper of the smoking article and the exterior of the truncated hollow cone of the airflow directing element. The drawn air passes through the aerosol-forming substrate and then passes downstream along the second portion of the airflow pathway through the interior of the truncated hollow cone towards the mouth end of the smoking article for inhalation by the user. The airflow directing element comprises an aerosol-modifying agent, which is entrained in the drawn air as it passes along one or both of the first portion and the second portion of the airflow pathway.

Where the airflow directing element comprises an annular air permeable diffuser, the drawn air passes through the annular air permeable diffuser as it passes along the first portion of the airflow pathway towards the aerosol-forming substrate.

In embodiments of the invention in which the airflow directing element comprises an inner wrapper, the inner wrapper may comprise the aerosol-modifying agent. The aerosol-modifying agent may be applied to the inner wrapper by, for example, coating, dipping, injecting, painting or spraying the inner wrapper with the aerosol-modifying agent.

The aerosol-modifying agent may be applied to the inner wrapper prior to formation of the airflow directing element. Alternatively or in addition, the aerosol-modifying agent may be applied to the inner wrapper during formation of the airflow directing element. Alternatively or in addition, the aerosol-modifying agent may be applied to the inner wrapper after formation of the airflow directing element.

Smoking articles according to the invention may comprise at least one additional air inlet.

For example, in embodiments where the aerosol-forming substrate is downstream of the heat source, smoking articles according to the invention may comprise at least one additional air inlet between a downstream end of the heat source and an upstream end of the aerosol-forming substrate. In such embodiments, when a user puffs on the mouth end of the smoking article cool air is also drawn into the smoking article through the at least one additional air inlet between the downstream end of the heat source and the upstream end of the aerosol-forming substrate. The air drawn through the at least one additional air inlet passes downstream through the aerosol-forming substrate and then downstream towards the mouth end of the smoking article through the second portion of the airflow pathway.

Alternatively or in addition, smoking articles according to the invention may comprise at least one additional air inlet about the periphery of the aerosol-forming substrate. In such embodiments, when a user puffs on the mouth end of the smoking article cool air is also drawn into the aerosol-forming substrate through the at least one additional air inlet about the periphery of the aerosol-forming substrate. The air drawn through the at least one additional air inlet passes downstream through the aerosol-forming substrate and then downstream towards the mouth end of the smoking article through the second portion of the airflow pathway.

The heat source is a combustible carbonaceous heat source. As used herein, the term 'carbonaceous' is used to describe a combustible heat source comprising carbon.

Preferably, combustible carbonaceous heat sources for use in smoking articles according to the invention have a carbon content of at least about 35 percent, more preferably of at least about 40 percent, most preferably of at least about 45 percent by dry weight of the combustible carbonaceous heat source.

In some embodiments, the heat source is a combustible carbon-based heat source. As used herein, the term 'carbon-based heat source' is used to describe a heat source comprised primarily of carbon.

Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible carbonaceous heat source is formed from a mixture of carbon powder, modified cellulose, flour and sugar.

Instead of, or in addition to one or more binders, combustible carbonaceous heat sources for use in smoking articles according to the invention may comprise one or more additives in order to improve the properties of the combustible carbonaceous heat source. Suitable additives include, but are not limited to, additives to promote consolidation of the combustible carbonaceous heat source (for example, sintering aids), additives to promote ignition of the combustible carbonaceous heat source (for example, oxidisers such as perchlorates, chlorates, nitrates, peroxides, permanganates, zirconium and combinations thereof), additives to promote combustion of the combustible carbonaceous heat source (for example, potassium and potassium salts, such as potassium citrate) and additives to promote decomposition of one or more gases produced by combustion of the combustible carbonaceous heat source (for example catalysts, such as CuO, $Fe_2O_3$ and $Al_2O_3$).

In one preferred embodiment, the combustible carbonaceous heat source is a cylindrical combustible carbonaceous heat source comprising carbon and at least one ignition aid, the cylindrical combustible carbonaceous heat source having a front end face (that is, upstream end face) and an opposed rear face (that is, downstream end face), wherein at least part of the cylindrical combustible carbonaceous heat source between the front face and the rear face is wrapped in a combustion resistant wrapper and wherein upon ignition of the front face of the cylindrical combustible carbonaceous heat source the rear face of the cylindrical combustible carbonaceous heat source increases in temperature to a first temperature and wherein during subsequent combustion of the cylindrical combustible carbonaceous heat source the rear face of the cylindrical combustible carbonaceous heat source maintains a second temperature lower than the first temperature. Preferably, the at least one ignition aid is present in an amount of at least about 20 percent by dry weight of the combustible carbonaceous heat source. Preferably, the combustion resistant wrapper is one or both of heat conducting and substantially oxygen impermeable.

As used herein, the term 'ignition aid' is used to denote a material that releases one or both of energy and oxygen during ignition of the combustible carbonaceous heat source, where the rate of release of one or both of energy and oxygen by the material is not ambient oxygen diffusion limited. In other words, the rate of release of one or both of energy and oxygen by the material during ignition of the combustible carbonaceous heat source is largely independent of the rate at which ambient oxygen can reach the material. As used herein, the term 'ignition aid' is also used to denote an elemental metal that releases energy during ignition of the combustible carbonaceous heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible carbonaceous heat source, such alkali metal burn salts do not release enough energy during ignition of a combustible carbonaceous heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible carbonaceous heat source, the inclusion of ignition and combustion additives can give rise to undesirable decomposition and reaction products during use of the smoking article. For example, decomposition of nitrates included in the combustible carbonaceous heat source to aid ignition thereof can result in the formation of nitrogen oxides. In addition, the inclusion of oxidisers, such as nitrates or other additives to aid ignition can result in generation of hot gases and high temperatures in the combustible carbonaceous heat source during ignition of the combustible carbonaceous heat source.

In smoking articles according to the invention the heat source is preferably isolated from all airflow pathways along which air may be drawn through the smoking article for inhalation by a user such that, in use, air drawn through the smoking article does not directly contact the heat source.

As used herein, the term 'isolated heat source' is used to describe a heat source that does not come into direct contact with air drawn through the smoking article along the airflow pathway.

As used herein, the term 'direct contact' is used to describe contact between air drawn through the smoking article along the airflow pathway and a surface of the heat source.

Isolation of the combustible carbonaceous heat source from air drawn through the smoking article advantageously substantially prevents or inhibits combustion and decomposition products and other materials formed during ignition and combustion of the combustible carbonaceous heat source of smoking articles according to the invention from entering air drawn through the smoking articles.

Isolation of the combustible carbonaceous heat source from air drawn through the smoking article also advantageously substantially prevents or inhibits activation of combustion of the combustible carbonaceous heat source of smoking articles according to the invention during puffing by a user. This substantially prevents or inhibits spikes in the temperature of the aerosol-forming substrate during puffing by a user.

By preventing or inhibiting activation of combustion of the combustible carbonaceous heat source, and so preventing or inhibiting excess temperature increases in the aerosol-forming substrate, combustion or pyrolysis of the aerosol-forming substrate of smoking articles according to the invention under intense puffing regimes may be advantageously avoided. In addition, the impact of a user's puffing regime on the composition of the mainstream aerosol of smoking articles according to the invention may be advantageously minimised or reduced.

Isolation of the heat source from the air drawn through the smoking article isolates the heat source from the aerosol-forming substrate. Isolation of the heat source from the aerosol-forming substrate may advantageously substantially prevent or inhibit migration of components of the aerosol-forming substrate of smoking articles according to the invention to the heat source during storage of the smoking articles.

Alternatively or in addition, isolation of the heat source from the air drawn through the smoking article may advantageously substantially prevent or inhibit migration of components of the aerosol-forming substrate of smoking articles according to the invention to the heat source during use of the smoking articles.

As described further below, isolation of the heat source from air drawn through the smoking article and the aerosol-forming substrate is particularly advantageous where the aerosol-forming substrate comprises at least one aerosol-former.

In embodiments where the aerosol-forming substrate is downstream of the combustible carbonaceous heat source, to isolate the combustible carbonaceous heat source from air drawn through the smoking article, smoking articles according to the invention may comprise a non-combustible, substantially air impermeable, barrier between a downstream end of the combustible carbonaceous heat source and an upstream end of the aerosol-forming substrate.

As used herein, the term 'non-combustible' is used to describe a barrier that is substantially non-combustible at temperatures reached by the combustible carbonaceous heat source during combustion or ignition thereof.

The barrier may abut one or both of the downstream end of the combustible carbonaceous heat source and the upstream end of the aerosol-forming substrate.

The barrier may be adhered or otherwise affixed to one or both of the downstream end of the combustible carbonaceous heat source and the upstream end of the aerosol-forming substrate.

In some embodiments, the barrier comprises a barrier coating provided on a rear face of the combustible carbonaceous heat source. In such embodiments, preferably the first barrier comprises a barrier coating provided on at least substantially the entire rear face of the combustible carbonaceous heat source. More preferably, the barrier comprises a barrier coating provided on the entire rear face of the combustible carbonaceous heat source.

As used herein, the term 'coating' is used to describe a layer of material that covers and is adhered to the combustible carbonaceous heat source.

The barrier may advantageously limit the temperature to which the aerosol-forming substrate is exposed during ignition or combustion of the combustible carbonaceous heat source, and so help to avoid or reduce thermal degradation or combustion of the aerosol-forming substrate during use of the smoking article. This is particularly advantageous where the combustible carbonaceous heat source comprises one or more additives to aid ignition of the combustible carbonaceous heat source.

Depending upon the desired characteristics and performance of the smoking article, the barrier may have a low thermal conductivity or a high thermal conductivity. In certain embodiments, the barrier may be formed from material having a bulk thermal conductivity of between about 0.1 Watts per meter Kelvin (W/(m·K)) and about 200 Watts per meter Kelvin (W/(m·K)) at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible carbonaceous heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In one embodiment, the barrier comprises a clay coating comprising a 50/50 mixture of bentonite and kaolinite provided on the rear face of the combustible carbonaceous heat source. In one more preferred embodiment, the barrier comprises an aluminium coating provided on a rear face of the combustible carbonaceous heat source. In another preferred embodiment, the barrier comprises a glass coating, more preferably a sintered glass coating, provided on a rear face of the combustible carbonaceous heat source.

Preferably, the barrier has a thickness of at least about 10 microns. Due to the slight permeability of clays to air, in embodiments where the barrier comprises a clay coating provided on the rear face of the combustible carbonaceous heat source the clay coating more preferably has a thickness of at least about 50 microns, and most preferably of between about 50 microns and about 350 microns. In embodiments where the barrier is formed from one or more materials that are more impervious to air, such as aluminium, the barrier may be thinner, and generally will preferably have a thickness of less than about 100 microns, and more preferably of about 20 microns. In embodiments where the barrier comprises a glass coating provided on the rear face of the combustible carbonaceous heat source, the glass coating preferably has a thickness of less than about 200 microns. The thickness of the barrier may be measured using a microscope, a scanning electron microscope (SEM) or any other suitable measurement methods known in the art.

Where the barrier comprises a barrier coating provided on a rear face of the combustible carbonaceous heat source, the barrier coating may be applied to cover and adhere to the rear face of the combustible carbonaceous heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear face of the combustible carbonaceous heat source, and applying it to the rear face of the combustible carbonaceous heat source to cover and adhere to at least substantially the entire rear face of the combustible carbonaceous heat source. Alternatively, the first barrier coating may be cut or otherwise machined after it is applied to the rear face of the combustible carbonaceous heat source. In one preferred embodiment, aluminium foil is applied to the rear face of the combustible carbonaceous heat source by gluing or pressing it to the combustible carbonaceous heat source, and is cut or otherwise machined so that the aluminium foil covers and adheres to at least substantially the entire rear face of the combustible carbonaceous heat source, preferably to the entire rear face of the combustible carbonaceous heat source.

In another preferred embodiment, the barrier coating is formed by applying a solution or suspension of one or more suitable coating materials to the rear face of the combustible carbonaceous heat source. For example, the barrier coating may be applied to the rear face of the combustible carbonaceous heat source by dipping the rear face of the combustible carbonaceous heat source in a solution or suspension of one or more suitable coating materials or by brushing or spray-coating a solution or suspension or electrostatically depositing a powder or powder mixture of one or more suitable coating materials onto the rear face of the combustible carbonaceous heat source. Where the barrier coating is applied to the rear face of the combustible carbonaceous heat source by electrostatically depositing a powder or powder mixture of one or more suitable coating materials onto the rear face of the combustible carbonaceous heat source, the rear face of the combustible carbonaceous heat source is preferably pre-treated with water glass before electrostatic deposition. Preferably, the barrier coating is applied by spray-coating.

The barrier coating may be formed through a single application of a solution or suspension of one or more suitable coating materials to the rear face of the combustible carbonaceous heat source. Alternatively, the barrier coating may be formed through multiple applications of a solution or suspension of one or more suitable coating materials to the rear face of the combustible carbonaceous heat source. For example, the barrier coating may be formed through one, two, three, four, five, six, seven or eight successive applications of a solution or suspension of one or more suitable coating materials to the rear face of the combustible carbonaceous heat source.

Preferably, the barrier coating is formed through between one and ten applications of a solution or suspension of one or more suitable coating materials to the rear face of the combustible carbonaceous heat source.

After application of the solution or suspension of one or more coating materials to the rear face thereof, the combustible carbonaceous heat source may be dried to form the barrier coating.

Where the barrier coating is formed through multiple applications of a solution or suspension of one or more suitable coating materials to the rear face thereof, the combustible carbonaceous heat source may need to be dried between successive applications of the solution or suspension.

Alternatively or in addition to drying, after application of a solution or suspension of one or more coating materials to the rear face of the combustible carbonaceous heat source, the coating material on the combustible carbonaceous heat source may be sintered in order to form the barrier coating. Sintering of the barrier coating is particularly preferred where the barrier coating is a glass or ceramic coating. Preferably, the barrier coating is sintered at a temperature of between about 500° C. and about 900° C., and more preferably at about 700° C.

As described further below, smoking articles according to the invention may comprise heat sources that are blind or non-blind.

As used herein, the term 'blind' is used to describe a heat source of a smoking article according to the invention in which air drawn through the smoking article for inhalation by a user does not pass through any airflow channels along the heat source.

As used herein, the term 'non-blind' is used to describe a heat source of a smoking article according to the invention in which air drawn through the smoking article for inhalation by a user passes through one or more airflow channels along the heat source.

As used herein, the term 'airflow channel' is used to describe a channel extending along the length of a heat source through which air may be drawn downstream for inhalation by a user.

In certain embodiments, smoking articles according to the invention may comprise heat sources that do not comprise any airflow channels. The heat sources of smoking articles according to such embodiments are referred to herein as blind heat sources.

In smoking articles according to the invention comprising blind heat sources, heat transfer from the heat source to the aerosol-forming substrate occurs primarily by conduction and heating of the aerosol-forming substrate by forced convection is minimised or reduced. This advantageously helps to minimise or reduce the impact of a user's puffing regime on the composition of the mainstream aerosol of smoking articles according to the invention comprising blind heat sources.

It will be appreciated that smoking articles according to the invention may comprise blind heat sources comprising one or more closed or blocked passageways through which air may not be drawn for inhalation by a user. For example, smoking articles according to the invention may comprise blind combustible carbonaceous heat sources comprising one or more closed passageways that extend from an upstream end face of the combustible carbonaceous heat source only part way along the length of the combustible carbonaceous heat source.

In such embodiments, the inclusion of one or more closed air passageways increases the surface area of the combustible carbonaceous heat source that is exposed to oxygen from the air and may advantageously facilitate ignition and sustained combustion of the combustible carbonaceous heat source.

In other embodiments, smoking articles according to the invention may comprise heat sources comprising one or more airflow channels. The heat sources of smoking articles according to such embodiments are referred to herein as non-blind heat sources.

In smoking articles according to the invention comprising non-blind heat sources, heating of the aerosol-forming substrate occurs by conduction and forced convection. In use, when a user puffs on a smoking article according to the invention comprising a non-blind heat source air is drawn downstream through the one or more airflow channels along the heat source. The drawn air passes through the aerosol-forming substrate and then downstream towards the mouth end of the smoking article through the second portion of the airflow pathway.

Smoking articles according to the invention may comprise non-blind heat sources comprising one or more enclosed airflow channels along the heat source.

As used herein, the term 'enclosed' is used to describe airflow channels that are surrounded by the heat source along their length.

For example, smoking articles according to the invention may comprise non-blind combustible carbonaceous heat sources comprising one or more enclosed airflow channels that extend through the interior of the combustible carbonaceous heat source along the entire length of the combustible carbonaceous heat source.

Alternatively or in addition, smoking articles according to the invention may comprise non-blind heat sources comprising one or more non-enclosed airflow channels along the combustible carbonaceous heat source.

For example, smoking articles according to the invention may comprise non-blind combustible carbonaceous heat sources comprising one or more non-enclosed airflow channels that extend along the exterior of the combustible carbonaceous heat source along at least a downstream portion of the length of the combustible carbonaceous heat source.

In certain embodiments, smoking articles according to the invention may comprise non-blind heat sources comprising one, two or three airflow channels. In certain preferred embodiments, smoking articles according to the invention comprise non-blind combustible carbonaceous heat sources comprising a single airflow channel extending through the interior of the combustible carbonaceous heat source. In certain particularly preferred embodiments, smoking articles according to the invention comprise non-blind combustible carbonaceous heat sources comprising a single substantially central or axial airflow channel extending through the interior of the combustible carbonaceous heat source. In such embodiments, the diameter of the single airflow channel is preferably between about 1.5 mm and about 3 mm.

Where smoking articles according to the invention comprise a barrier comprising a barrier coating provided on a rear face of a non-blind combustible carbonaceous heat source comprising one or more airflow channels along the combustible carbonaceous heat source, the barrier coating should allow air to be drawn downstream through the one or more airflow channels.

Where smoking articles according to the invention comprise non-blind combustible carbonaceous heat sources, the smoking articles may further comprise a non-combustible, substantially air impermeable, barrier between the combustible carbonaceous heat source and the one or more airflow channels to isolate the non-blind combustible carbonaceous heat source from air drawn through the smoking article.

In some embodiments, the barrier may be adhered or otherwise affixed to the combustible carbonaceous heat source.

Preferably, the barrier comprises a barrier coating provided on an inner surface of the one or more airflow channels. More preferably, the barrier comprises a barrier coating provided on at least substantially the entire inner surface of the one or more airflow channels. Most preferably, the barrier comprises a barrier coating provided on the entire inner surface of the one or more airflow channels.

Alternatively, the barrier coating may be provided by insertion of a liner into the one or more airflow channels. For example, where smoking articles according to the invention comprise non-blind combustible carbonaceous heat sources comprising one or more airflow channels that extend through the interior of the combustible carbonaceous heat source, a non-combustible, substantially air impermeable hollow tube may be inserted into each of the one or more airflow channels.

The barrier may advantageously substantially prevent or inhibit combustion and decomposition products formed during ignition and combustion of the combustible carbonaceous heat source of smoking articles according to the invention from entering air drawn downstream along the one or more airflow channels.

The barrier may also advantageously substantially prevent or inhibit activation of combustion of the combustible carbonaceous heat source of smoking articles according to the invention during puffing by a user.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the combustible carbonaceous heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where smoking articles according to the invention comprise a barrier between a downstream end of the combustible carbonaceous heat source and an upstream end of the aerosol-forming substrate and a barrier between the combustible carbonaceous heat source and one or more airflow channels along the combustible carbonaceous heat source, the two barriers may be formed from the same or different material or materials.

Where the barrier between the combustible carbonaceous heat source and the one or more airflow channels comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In a preferred embodiment, the barrier coating is applied to the inner surface of the one or more airflow channels by the process described in WO-A2-2009/074870 as the combustible carbonaceous heat source is extruded.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction. In certain preferred embodiments, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In one embodiment, at least one metal nitrate salt is incorporated in the combustible carbonaceous heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible carbonaceous heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In use, exposure of the combustible carbonaceous heat source to a conventional yellow flame lighter or other ignition means should cause the at least one metal nitrate salt to decompose and release oxygen and energy. This decomposition causes an initial boost in the temperature of the combustible carbonaceous heat source and also aids in the ignition of the combustible carbonaceous heat source. Following decomposition of the at least one metal nitrate salt, the combustible carbonaceous heat source preferably continues to combust at a lower temperature.

The inclusion of at least one metal nitrate salt advantageously results in ignition of the combustible carbonaceous heat source being initiated internally, and not only at a point on the surface thereof. Preferably, the at least one metal nitrate salt is present in the combustible carbonaceous heat source in an amount of between about 20 percent by dry weight and about 50 percent by dry weight of the combustible carbonaceous heat source.

In another embodiment, the combustible carbonaceous heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible carbonaceous heat source to a conventional yellow flame lighter or other ignition means should cause the at least one peroxide or superoxide to decompose and release oxygen. This causes an initial boost in the temperature of the combustible carbonaceous heat source and also aids in the ignition of the combustible carbonaceous heat source. Following decomposition of the at least one peroxide or superoxide, the combustible carbonaceous heat source preferably continues to combust at a lower temperature.

The inclusion of at least one peroxide or superoxide advantageously results in ignition of the combustible carbonaceous heat source being initiated internally, and not only at a point on the surface thereof.

The combustible carbonaceous heat source preferably has a porosity of between about 20 percent and about 80 percent, more preferably of between about 20 percent and 60 percent.

Where the combustible carbonaceous heat source comprises at least one metal nitrate salt, this advantageously allows oxygen to diffuse into the mass of the combustible carbonaceous heat source at a rate sufficient to sustain combustion as the at least one metal nitrate salt decomposes and combustion proceeds. Even more preferably, the combustible carbonaceous heat source has a porosity of between about 50 percent and about 70 percent, more preferably of between about 50 percent and about 60 percent as measured by, for example, mercury porosimetry or helium pycnometry. The required porosity may be readily achieved during production of the combustible carbonaceous heat source using conventional methods and technology.

Advantageously, combustible carbonaceous heat sources for use in smoking articles according to the invention have an apparent density of between about 0.6 g/cm$^3$ and about 1 g/cm$^3$.

Preferably, the combustible carbonaceous heat source has a mass of between about 300 mg and about 500 mg, more preferably of between about 400 mg and about 450 mg.

Preferably, the combustible carbonaceous heat source has a length of between about 7 mm and about 17 mm, more preferably of between about 7 mm and about 15 mm, most preferably of between about 7 mm and about 13 mm.

Preferably, the combustible carbonaceous heat source has a diameter of between about 5 mm and about 9 mm, more preferably of between about 7 mm and about 8 mm.

Preferably, the heat source is of substantially uniform diameter. However, the heat source may alternatively be tapered so that the diameter of the rear portion of the heat source is greater than the diameter of the front portion thereof. Particularly preferred are heat sources that are substantially cylindrical. The heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former. The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

In such embodiments, isolation of the heat source from the aerosol-forming substrate advantageously prevents or inhibits migration of the at least one aerosol-former from the aerosol-forming substrate to the heat source during storage of the smoking articles. In such embodiments, isolation of the heat source from air drawn through the smoking article may also advantageously substantially prevent or inhibit migration of the at least one aerosol former from the aerosol-forming substrate to the heat source during use of the smoking articles. Decomposition of the at least one aerosol-former during use of the smoking articles is thus advantageously substantially avoided or reduced.

In embodiments where the aerosol-forming substrate is downstream of the heat source, the heat source and aerosol-forming substrate of smoking articles according to the invention may substantially abut one another. Alternatively, the heat source and aerosol-forming substrate of smoking articles according to the invention may be longitudinally spaced apart from one another one another.

In embodiments where the aerosol-forming substrate is downstream of the heat source, smoking articles according to the invention preferably further comprise a heat-conducting element around and in direct contact with a rear portion of the heat source and an adjacent front portion of the aerosol-forming substrate. The heat-conducting element is preferably combustion resistant and oxygen restricting.

The heat-conducting element is around and in direct contact with the peripheries of both the rear portion of the combustible carbonaceous heat source and the front portion of the aerosol-generating substrate. The heat-conducting element provides a thermal link between these two components of smoking articles according to the invention.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

In such embodiments, the rear portion of the combustible carbonaceous heat source surrounded by the heat-conducting element is preferably between about 2 mm and about 8 mm in length, more preferably between about 3 mm and about 5 mm in length.

Preferably, the front portion of the combustible carbonaceous heat source not surrounded by the heat-conducting element is between about 4 mm and about 15 mm in length, more preferably between about 4 mm and about 8 mm in length.

Preferably, the aerosol-forming substrate has a length of between about 5 mm and about 20 mm, more preferably of between about 8 mm and about 12 mm.

In certain preferred embodiments, the aerosol-forming substrate extends at least about 3 mm downstream beyond the heat-conducting element.

Preferably, the front portion of the aerosol-forming substrate surrounded by the heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the heat-conducting element is between about 3 mm and about 10 mm in length. In other words, the aerosol-forming substrate preferably extends between about 3 mm and about 10 mm downstream beyond the heat-conducting element. More preferably, the aerosol-forming substrate extends at least about 4 mm downstream beyond the heat-conducting element.

In other embodiments, the aerosol-forming substrate may extend less than 3 mm downstream beyond the heat-conducting element.

In yet further embodiments, the entire length of the aerosol-forming substrate may be surrounded by the heat-conducting element.

Preferably, smoking articles according to the invention comprise aerosol-forming substrates comprising at least one aerosol-former and a material capable of emitting volatile compounds in response to heating. Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

The aerosol-forming substrate may comprise an aerosol-modifying agent. The aerosol directing element and the aerosol-forming substrate may comprise the same aerosol-modifying agent or different aerosol-modifying agents. Preferably, the aerosol directing element and the aerosol-forming substrate comprise the same aerosol-modifying agent. This advantageously increases the level of delivery of the aerosol-modifying agent to a user. In a particularly preferred embodiment, the aerosol directing element and the aerosol-forming substrate comprise menthol.

An aerosol-modifying agent may be applied to one or more materials from which the aerosol-forming substrate is formed prior to formation of the aerosol-forming substrate. Alternatively or in addition, an aerosol-modifying agent may be applied to the aerosol-forming substrate during formation of the aerosol-forming substrate. Alternatively or in addition, an aerosol-modifying agent may be applied to the aerosol-forming substrate after formation of the aerosol-forming substrate.

The aerosol-modifying agent may be applied to the aerosol-forming substrate by, for example, coating, dipping, injecting, painting or spraying the aerosol-forming substrate with the aerosol-modifying agent.

Alternatively or in addition, the aerosol-forming substrate may comprise a substrate comprising an aerosol-modifying agent.

The aerosol-modifying agent may be applied to the substrate by, for example, coating, dipping, injecting, painting or spraying the substrate with the aerosol-modifying agent.

The substrate may be a porous sorption element. Suitable porous materials are well known in the art and include, but are not limited to, cellulose acetate tow, cotton, open-cell ceramic and polymer foams, paper, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

In certain preferred embodiments, the substrate is a non-laminar fibrous substrate. In certain particularly preferred embodiments, the non-laminar fibrous substrate is a thread.

Preferably, the longitudinal axis of the non-laminar fibrous substrate is disposed substantially parallel to the longitudinal axis of the smoking article.

Smoking articles according to the invention preferably further comprise an expansion chamber downstream of the airflow directing element. The inclusion of an expansion chamber advantageously allows further cooling of the aerosol generated by heat transfer from the combustible carbonaceous heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

The expansion chamber may comprise an aerosol-modifying agent. For example, where the expansion chamber is an elongate hollow tube, an aerosol-modifying agent may be applied to the interior of the expansion chamber. The aerosol directing element and the expansion chamber may comprise the same aerosol-modifying agent or different aerosol-modifying agents. Preferably, the aerosol directing element and the expansion chamber comprise the same aerosol-modifying agent. This advantageously increases the level of delivery of the aerosol-modifying agent to a user. In a particularly preferred embodiment, the aerosol directing element and the expansion chamber comprise menthol.

An aerosol-modifying agent may be applied to one or more materials from which the expansion chamber is formed prior to formation of the expansion chamber. Alternatively or in addition, an aerosol-modifying agent may be applied to the expansion chamber during formation of the expansion chamber. Alternatively or in addition, an aerosol-modifying agent may be applied to the expansion chamber after formation of the expansion chamber.

The aerosol-modifying agent may be applied to the expansion chamber by, for example, coating, painting, or spraying the interior of the expansion chamber with the aerosol-modifying agent.

Alternatively or in addition, the expansion chamber may comprise a substrate comprising an aerosol-modifying agent.

The aerosol-modifying agent may be applied to the substrate by, for example, coating, dipping, injecting, painting or spraying the substrate with the aerosol-modifying agent.

The substrate may be a porous sorption element. Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

The substrate may be a non-laminar fibrous substrate. The non-laminar fibrous substrate may be a thread.

Preferably, the longitudinal axis of the non-laminar fibrous substrate is disposed substantially parallel to the longitudinal axis of the smoking article.

Smoking articles according to the invention preferably, further comprise an aerosol-cooling element downstream of the airflow directing element and, where present, downstream of the expansion chamber.

As used herein, the term 'aerosol-cooling element' is used to describe an element having a large surface area and a low resistance-to-draw. In use, an aerosol formed by volatile compounds released from the aerosol-forming substrate passes over and is cooled by the aerosol-cooling element before being inhaled by a user. Chambers and cavities within an aerosol-generating article are also not considered to be aerosol-cooling elements. The aerosol-cooling element may be alternatively termed a heat exchanger.

The aerosol-cooling element may have a total surface area of between approximately 300 $m^2$ per mm length and approximately 1000 $m^2$ per mm length. In a preferred embodiment, the aerosol-cooling element has a total surface area of approximately 500 $mm^2$ per mm length.

The aerosol-cooling element preferably has a low resistance to draw. That is, the aerosol-cooling element preferably offers a low resistance to the passage of air through the smoking article. Preferably, the aerosol-cooling element does not substantially affect the resistance to draw of the smoking article.

Preferably, the aerosol-cooling element has a porosity of between 50% and 90% in the longitudinal direction. The porosity of the aerosol-cooling element in the longitudinal direction is defined by the ratio of the cross-sectional area of material forming the aerosol-cooling element and the internal cross-sectional area of the smoking article at the position of the aerosol-cooling element.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

Preferably, the airflow through the aerosol-cooling element does not deviate to a substantive extent between adjacent channels. In other words, it is preferred that the airflow through the aerosol-cooling element is in a longitudinal direction along a longitudinal channel, without substantive radial deviation. In some embodiments, the aerosol-cooling element is formed from a material that has a low porosity, or substantially no-porosity other than the longitudinally extending channels. For example, the aerosol-cooling element may be formed from a sheet material having low porosity or substantially no porosity that has been one or more of crimped, pleated, gathered and folded to form the channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-cooling element may be formed from a gathered sheet of material having a specific surface area of between approximately 10 $mm^2$ per mg and approximately 100 $mm^2$ per mg weight. In some embodiments, the aerosol-cooling element may be formed from a gathered sheet of material having a specific surface area of approximately 35 $mm^2$ per mg.

When an aerosol that contains a proportion of water vapour is drawn through the aerosol-cooling element, some of the water vapour may condense on a surface of the aerosol-cooling element. In such cases, it is preferred that the condensed water remains in droplet form on the surface of the aerosol-cooling element rather than being absorbed into the aerosol-cooling element. Thus, it is preferred that the aerosol-cooling element is formed from material that is substantially non-porous or substantially non-absorbent to water.

The aerosol-cooling element acts to cool the temperature of a stream of aerosol drawn through the aerosol-cooling element by means of thermal transfer. Components of the aerosol will interact with the aerosol-cooling element and loose thermal energy.

The aerosol-cooling element may act to cool the temperature of a stream of aerosol drawn through the aerosol-cooling element by undergoing a phase transformation that consumes heat energy from the aerosol stream. For example, the aerosol-cooling element may be formed from a material that undergoes an endothermic phase transformation such as melting or a glass transition.

The aerosol-cooling element may act to lower the temperature of a stream of aerosol drawn through the aerosol-cooling element by causing condensation of components such as water vapour from the aerosol stream. Due to condensation, the aerosol stream may be drier after passing through the aerosol-cooling element. In some embodiments, the water vapour content of an aerosol stream drawn through the aerosol-cooling element may be lowered by between approximately 20% and approximately 90%. The user may perceive the temperature of a drier aerosol to be lower than the temperature of a moister aerosol of the same actual temperature.

In some embodiments, the temperature of an aerosol stream may be lowered by more than 10 degrees Celsius as it is drawn through the aerosol-cooling element. In some embodiments, the temperature of an aerosol stream may be lowered by more than 15 degrees Celsius or more than 20 degrees Celsius as it is drawn through the aerosol-cooling element.

In some embodiments, the aerosol-cooling element removes a proportion of the water vapour content of an aerosol drawn through the aerosol-cooling element. In some embodiments, a proportion of other volatile substances may be removed from the aerosol stream as the aerosol is drawn through the aerosol-cooling element. For example, in some embodiments a proportion of phenolic compounds may be removed from the aerosol stream as the aerosol is drawn through the aerosol-cooling element.

Phenolic compounds may be removed by interaction with the material forming the aerosol-cooling element. For example, the aerosol-cooling element may be formed from a material that adsorbs the phenolic compounds (for example phenols and cresols).

Phenolic compounds may be removed by interaction with water droplets condensed on the surface of the aerosol-cooling element.

As noted above, the aerosol-cooling element may be formed from a sheet of suitable material that has been one or more of crimped, pleated, gathered or folded to define a plurality of longitudinally extending channels. A cross-sectional profile of such an aerosol-cooling element may show the channels as being randomly oriented. The aerosol-cooling element may be formed by other means. For example, the aerosol-cooling element may be formed from a bundle of longitudinally extending tubes. The aerosol-cooling element may be formed by extrusion, molding, lamination, injection, or shredding of a suitable material.

The aerosol-cooling element may comprise an inner wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by an inner wrapper, for example an inner wrapper of filter paper.

The aerosol-cooling element may have a diameter of between about 5 mm and about 9 mm, more preferably of between about 7 mm and about 8 mm.

The aerosol-cooling element may have a length of between about 5 mm and approximately 25 mm.

The aerosol-cooling element may comprise an aerosol-modifying agent. The aerosol directing element and the aerosol-cooling element may comprise the same aerosol-modifying agent or different aerosol-modifying agents. Preferably, the aerosol directing element and the aerosol-cooling element comprise the same aerosol-modifying agent. This advantageously increases the level of delivery of the aerosol-modifying agent to a user. In a particularly preferred embodiment, the aerosol directing element and the aerosol-cooling element comprise menthol.

An aerosol-modifying agent may be applied to one or more materials from which the aerosol-cooling element is formed prior to formation of the aerosol-cooling element. Alternatively or in addition, an aerosol-modifying agent may be applied to the aerosol-cooling element during formation of the aerosol-cooling element. Alternatively or in addition, an aerosol-modifying agent may be applied to the aerosol-cooling element after formation of the aerosol-cooling element.

In embodiments where the aerosol-cooling element is formed from a gathered sheet of material, the gathered sheet of material may comprise an aerosol-modifying agent.

Alternatively or in addition, in embodiments where the aerosol-cooling element comprises an inner wrapper, the inner wrapper may comprise an aerosol-modifying agent Alternatively or in addition, the aerosol-cooling element may comprise a substrate comprising an aerosol-modifying agent located in a longitudinally extending channel of the aerosol-cooling element.

The aerosol-modifying agent may be applied to one or more of the gathered sheet of material, the inner wrapper and the substrate by, for example, coating, dipping, injecting, painting or spraying one or more of the gathered sheet of material, the inner wrapper and the substrate with the aerosol-modifying agent.

The substrate may be a porous sorption element. Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

In certain preferred embodiments, the substrate is a non-laminar fibrous substrate. In certain particularly preferred embodiments, the non-laminar fibrous substrate is a thread.

Preferably, the longitudinal axis of the non-laminar fibrous substrate is disposed substantially parallel to the longitudinal axis of the smoking article.

Smoking articles according to the invention preferably, further comprise a mouthpiece downstream of the airflow directing element and, where present, downstream of the expansion chamber and aerosol-cooling element. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may, for example, comprise a filter made of cellulose acetate, paper or other suitable known filtration materials.

The mouthpiece may comprise an aerosol-modifying agent. The aerosol directing element and the mouthpiece may comprise the same aerosol-modifying agent or different aerosol-modifying agents. Preferably, the aerosol directing element and the mouthpiece comprise the same aerosol-modifying agent. This advantageously increases the level of delivery of the aerosol-modifying agent to a user. In a particularly preferred embodiment, the aerosol directing element and the mouthpiece comprise menthol.

An aerosol-modifying agent may be applied to one or more materials from which the mouthpiece is formed prior to formation of the mouthpiece. Alternatively or in addition, an aerosol-modifying agent may be applied to the mouthpiece during formation of the aerosol-cooling element. Alternatively or in addition, an aerosol-modifying agent may be applied to the mouthpiece after formation of the mouthpiece.

In certain embodiments, the mouthpiece may comprise a plug of porous filtration material, for example cellulose acetate tow or paper, circumscribed by an inner wrapper, for example a filter plug wrap. In such embodiments, one or both of the plug of porous filtration material and the inner wrapper may comprise an aerosol-modifying agent.

The mouthpiece may comprise a substrate comprising an aerosol-modifying agent. In embodiments where the mouthpiece comprises a plug of porous filtration material circumscribed by an inner wrapper, the mouthpiece may comprise a substrate comprising an aerosol-modifying agent located in the plug of porous filtration material.

The aerosol-modifying agent may be applied to the substrate by, for example, coating, dipping, injecting, painting or spraying the substrate with the aerosol-modifying agent.

The substrate may be a porous sorption element. Suitable porous materials are well known in the art and include, but are not limited to, cellulose acetate tow, cotton, open-cell ceramic and polymer foams, paper, tobacco material, porous ceramic elements, porous plastics elements, porous carbon elements, porous metallic elements and combinations thereof.

The substrate may be a laminar substrate or a non-laminar substrate.

The substrate may be a fibrous or non-fibrous substrate. For example, the substrate may be a fibrous cotton substrate or a fibrous paper substrate.

Preferably, the substrate is a non-laminar substrate.

In certain preferred embodiments, the substrate is a non-laminar fibrous substrate. In certain particularly preferred embodiments, the non-laminar fibrous substrate is a thread.

Preferably, the longitudinal axis of the non-laminar fibrous substrate is disposed substantially parallel to the longitudinal axis of the smoking article.

Smoking articles according to the invention may be packaged in containers comprising an aerosol-modifying agent. The aerosol directing element and the container may comprise the same aerosol-modifying agent or different aerosol-modifying agents. Preferably, the aerosol directing element and the container comprise the same aerosol-modifying agent. This advantageously increases the level of delivery of the aerosol-modifying agent to a user. In a particularly preferred embodiment, the aerosol directing element and the container comprise with menthol.

For example, a bundle of smoking articles according to the invention may be housed in a hinge-lid or slide and shell container comprising an aerosol-modifying agent. The bundle of smoking articles may be wrapped in an inner liner comprising the aerosol-modifying agent. The inner liner may be formed from any suitable material or combination of materials, including, but not limited to, metal foil or metallised paper. The aerosol-modifying agent may be applied to the inner liner by, for example, coating, dipping, painting or spraying the inner liner with the aerosol-modifying agent.

Features described in relation to one aspect of the invention may also be applicable to other aspects of the invention.

The invention will be further described, by way of example only, with reference to the accompanying drawings in which.

Figure 1:
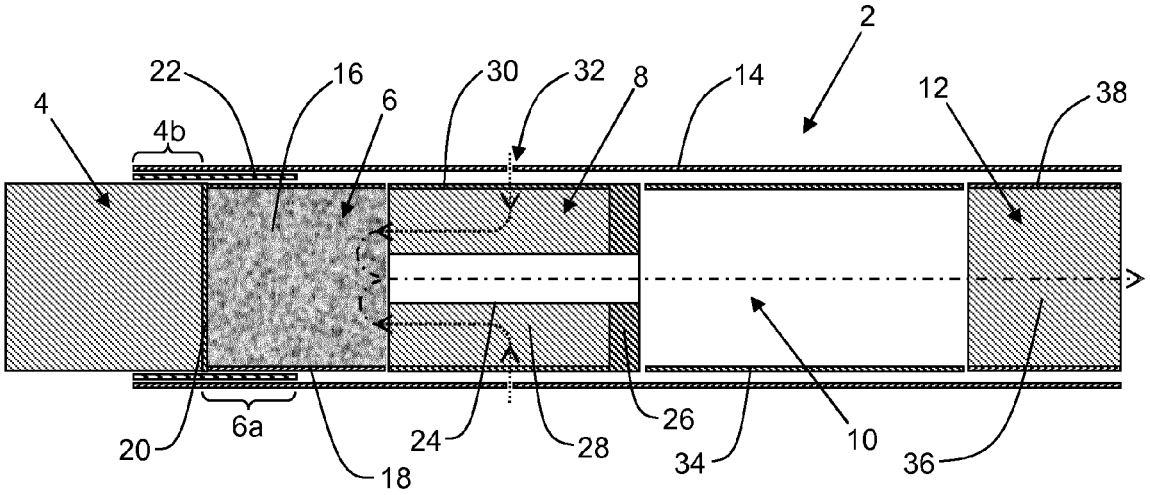
FIG. 1 shows a schematic longitudinal cross-section of a smoking article according to a first embodiment of the invention.

The smoking article 2 according to the first embodiment of the invention shown in FIG. 1 comprises a blind combustible carbonaceous heat source 4, an aerosol-forming substrate 6, an airflow directing element 8, an expansion chamber 10 and a mouthpiece 12 in abutting coaxial alignment. The combustible carbonaceous heat source 4, aerosol-forming substrate 6, airflow directing element 8, elongate expansion chamber 10 and mouthpiece 12 are overwrapped in an outer wrapper 14 of cigarette paper of low air permeability.

The aerosol-forming substrate 6 is located immediately downstream of the combustible carbonaceous heat source 4 and comprises a cylindrical plug 16 of tobacco material comprising glycerine as aerosol former and circumscribed by filter plug wrap 18.

A non-combustible, substantially air impermeable barrier is provided between the downstream end of the combustible carbonaceous heat source 4 and the upstream end of the aerosol-forming substrate 6. As shown in FIG. 1, the non-combustible, substantially air impermeable barrier consists of a non-combustible, substantially air impermeable, barrier coating 20, which is provided on the entire rear face of the combustible carbonaceous heat source 4.

A heat-conducting element 22 consisting of a tubular layer of aluminium foil surrounds and is in direct contact with a rear portion 4*b* of the combustible carbonaceous heat source 4 and an abutting front portion 6*a* of the aerosol-forming substrate 6. As shown in FIG. 1, a rear portion of the aerosol-forming substrate 6 is not surrounded by the heat-conducting element 22.

The airflow directing element 8 is located downstream of the aerosol-forming substrate 6 and comprises an open-ended, substantially air impermeable hollow tube 24 made of, for example, cardboard, which is of reduced diameter compared to the aerosol-forming substrate 6. The upstream end of the open-ended hollow tube 24 abuts the aerosol-forming substrate 6. The downstream end of the open-ended hollow tube 24 is surrounded by an annular substantially air impermeable seal 26 of substantially the same diameter as the aerosol-forming substrate 6. The remainder of the open-ended hollow tube 24 is circumscribed by an annular air permeable diffuser 28 made of, for example, cellulose acetate tow, which is of substantially the same diameter as the aerosol-forming substrate 6.

The open-ended hollow tube 24, annular substantially air impermeable seal 26 and annular air permeable diffuser 28 may be separate components that are adhered or otherwise connected together to form the airflow directing element 8 prior to assembly of the smoking article 2. Alternatively, the open-ended hollow tube 24 and annular substantially air impermeable seal 26 may be parts of a single component that is adhered or otherwise connected to a separate annular air permeable diffuser 28 to form the airflow directing element 8 prior to assembly of the smoking article. In yet further embodiments, the open-ended hollow tube 24, annular substantially air impermeable seal 26 and annular air permeable diffuser 28 may be parts of a single component. For example, the open-ended hollow tube 24, annular substantially air impermeable seal 26 and annular air permeable diffuser 28 may be parts of a single hollow tube of air permeable material having a substantially air impermeable coating applied to its inner surface and rear face.

The airflow directing element 8 comprises an aerosol-modifying agent. The aerosol-modifying agent may be applied to the annular air permeable diffuser 28. Alternatively or in addition, the aerosol-modifying agent may be applied to the interior of the open-ended hollow tube 24.

As shown in FIG. 1, the open-ended hollow tube 24 and annular air permeable diffuser 28 are circumscribed by an air permeable inner wrapper 30.

As also shown in FIG. 1, a circumferential arrangement of air inlets 32 is provided in the outer wrapper 14 circumscribing the inner wrapper 30.

The expansion chamber 10 is located downstream of the airflow directing element 8 and comprises an open-ended hollow tube 34 made of, for example, cardboard, which is of substantially the same diameter as the aerosol-forming substrate 6.

The mouthpiece 12 of the smoking article 2 is located downstream of the expansion chamber 10 and comprises a cylindrical plug 36 of cellulose acetate tow of very low filtration efficiency circumscribed by filter plug wrap 38. The mouthpiece 12 may be circumscribed by tipping paper (not shown).

As described further below, an airflow pathway extends between the air inlets 32 and the mouthpiece 12 of the smoking article 2 according to the first embodiment of the invention. The volume bounded by the exterior of the open-ended hollow tube 24 of the airflow directing element 8 and the inner wrapper 30 forms a first portion of the airflow pathway that extends from the air inlets 32 to the aerosol-forming substrate 6. The volume bounded by the interior of the hollow tube 24 of the airflow directing element 8 forms a second portion of the airflow pathway that extends downstream towards the mouth piece 12 of the smoking article 2, between the aerosol-forming substrate 6 and the expansion chamber 10.

In use, when a user draws on the mouthpiece 12 of the smoking article 2 according to the first embodiment of the invention, cool air (shown by dotted arrows in FIG. 1) is drawn into the smoking article 2 through the air inlets 32 and the inner wrapper 30. The drawn air passes to the aerosol-forming substrate 6 along the first portion of the airflow pathway between the exterior of the open-ended hollow tube 24 of the airflow directing element 8 and the inner wrapper 30 and through the annular air permeable diffuser 28.

The front portion 6*a* of the aerosol-forming substrate 6 is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 1) pass downstream along the second portion of the airflow pathway through the interior of the open-ended hollow tube 24 of the airflow directing element 8 to the expansion chamber 10, where they cool and condense. The cooled aerosol then passes downstream through the mouthpiece 12 of the smoking article 2 according to the first embodiment of the invention into the mouth of the user.

As the drawn air passes between the exterior of the open-ended hollow tube 24 of the airflow directing element 8 and the inner wrapper 30 and through the annular air permeable diffuser 28 and downstream through the interior of the open-ended hollow tube 24 of the airflow directing element 8, the aerosol-modifying agent loaded on the airflow directing element 8 is also entrained in the drawn air and mixes with the volatile and semi-volatile compounds and glycerine released aerosol-forming substrate 6. To increase the level of aerosol-modifying agent in the aerosol delivered to the user, one or more of the aerosol-forming substrate 6, the expansion chamber 10 and the mouthpiece 12 of the smoking article 2 may also comprise the aerosol-modifying agent.

The non-combustible, substantially air impermeable, barrier coating 20 provided on the rear face of the combustible carbonaceous heat source 4 isolates the combustible carbonaceous heat source 4 from the airflow pathway through the smoking article 2 such that, in use, air drawn through the smoking article 2 along the first portion and the second portion of the airflow pathway does not directly contact the combustible carbonaceous heat source 4.

Figure 2:
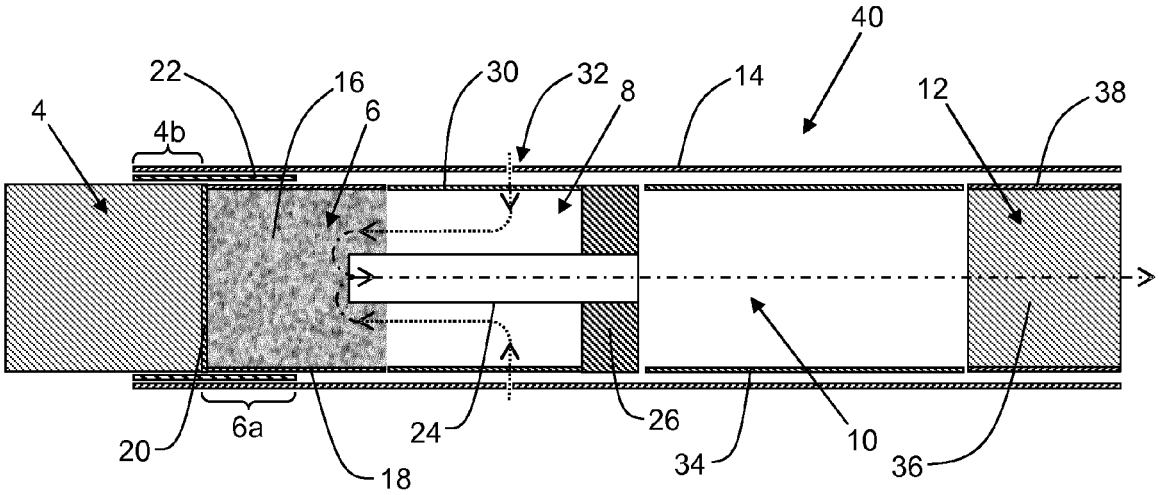
FIG. 2 shows a schematic longitudinal cross-section of a smoking article according to a second embodiment of the invention.

The smoking article 40 according to the second embodiment of the invention shown in FIG. 2 is of similar construction to the smoking article according to the first embodiment of the invention shown in FIG. 1; the same reference numerals are used in FIG. 2 for parts of the smoking article 40 according to the second embodiment of the invention corresponding to parts of the smoking article 2 according to the first embodiment of the invention shown in FIG. 1 and described above.

As shown in FIG. 2, the smoking article 40 according to the second embodiment of the invention differs from the smoking article 2 according to the first embodiment of the invention shown in FIG. 1 in that the open-ended, substantially air impermeable hollow tube 24 of the airflow directing element 8 is not circumscribed by an annular air permeable diffuser 28. The smoking article 40 according to the second embodiment of the invention also differs from the smoking article 2 according to the first embodiment of the invention shown in FIG. 1 in that the upstream end of the open-ended hollow tube 24 extends into the aerosol-forming substrate 6.

The airflow directing element 8 of the smoking article 40 according to the second embodiment of the invention comprises an aerosol-modifying agent. The aerosol-modifying agent may be applied to the exterior of the open-ended hollow tube 24. Alternatively or in addition, the aerosol-modifying agent may be applied to the interior of the open-ended hollow tube 24.

In use, when a user draws on the mouthpiece 12 of the smoking article 40 according to the second embodiment of the invention, cool air (shown by dotted arrows in FIG. 2) is drawn into the smoking article 40 through the air inlets 32. The drawn air passes to the aerosol-forming substrate 6 along the first portion of the airflow pathway between the exterior of the open-ended hollow tube 24 of the airflow directing element 8 and the inner wrapper 30.

The front portion 6*a* of the aerosol-forming substrate 6 of the smoking article 40 according to the second embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 2) pass downstream along the second portion of the airflow pathway through the interior of the open-ended hollow tube 24 of the airflow directing element 8 to the expansion chamber 10, where they cool and condense. The cooled aerosol then passes downstream through the mouthpiece 12 of the smoking article 40 according to the second embodiment of the invention into the mouth of the user.

As the drawn air passes between the exterior of the open-ended hollow tube 24 of the airflow directing element 8 and the inner wrapper 30 and downstream through the interior of the open-ended hollow tube 24 of the airflow directing element 8, the aerosol-modifying agent loaded on the airflow directing element 8 is also entrained in the drawn air and mixes with the volatile and semi-volatile compounds and glycerine released aerosol-forming substrate 6. To increase the level of aerosol-modifying agent in the aerosol delivered to the user, one or more of the aerosol-forming substrate 6, the expansion chamber 10 and the mouthpiece 12 of the smoking article 40 may also comprise the aerosol-modifying agent.

The non-combustible, substantially air impermeable, barrier coating 20 provided on the rear face of the combustible carbonaceous heat source 4 isolates the combustible carbonaceous heat source 4 from the airflow pathway through the smoking article 40 such that, in use, air drawn through the smoking article 40 along the first portion and the second portion of the airflow pathway does not directly contact the combustible carbonaceous heat source 4.

Figure 3:
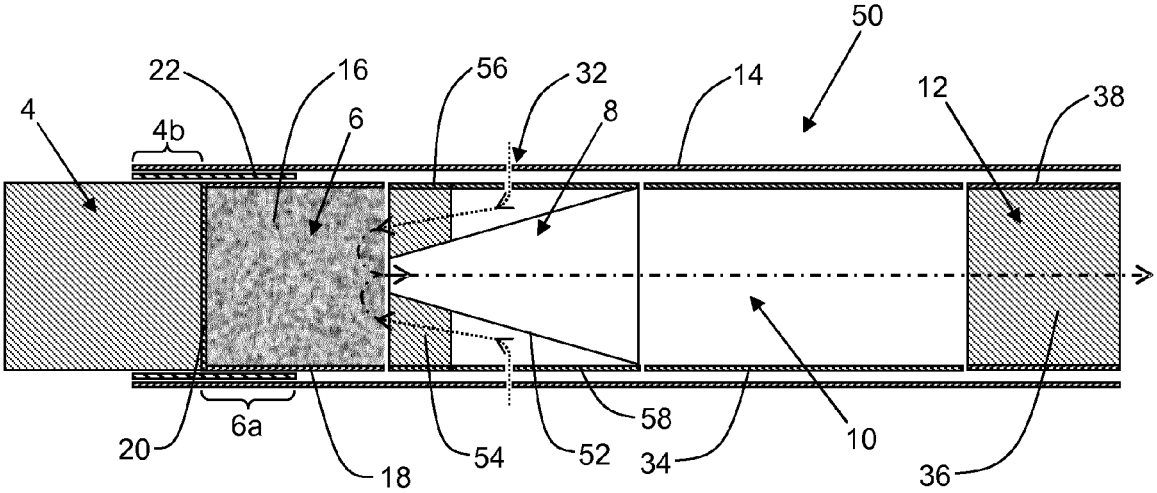
FIG. 3 shows a schematic longitudinal cross-section of a smoking article according to a third embodiment of the invention.

The smoking article 50 according to the third embodiment of the invention shown in FIG. 3 is also of similar construction to the smoking article according to the first embodiment of the invention shown in FIG. 1; the same reference numerals are used in FIG. 3 for parts of the smoking article 50 according to the third embodiment of the invention corresponding to parts of the smoking article 2 according to the first embodiment of the invention shown in FIG. 1 and described above.

As shown in FIG. 3, the construction of the airflow directing element 8 of the smoking article 50 according to the third embodiment of the invention differs from that of the airflow directing element 8 of the smoking article according to the first embodiment of the invention shown in FIG. 1. In the third embodiment of the invention, the airflow directing element 8 is located downstream of the aerosol-forming substrate 6 and comprises an open-ended, substantially air impermeable truncated hollow cone 52 made of, for example, cardboard. The downstream end of the open-ended truncated hollow cone 52 is of substantially the same diameter as the aerosol-forming substrate 6 and the upstream end of the open-ended truncated hollow cone 52 is of reduced diameter compared to the aerosol-forming substrate 6.

The upstream end of the hollow cone 52 abuts the aerosol-forming substrate 6 and is circumscribed by an air permeable cylindrical plug 54 of substantially the same diameter as the aerosol-forming substrate 6. The air permeable cylindrical plug 58 may be formed from any suitable material including, but not limited to porous materials such as, for example, cellulose acetate tow of very low filtration efficiency.

The upstream end of the open-ended truncated hollow cone 52 abuts the aerosol-forming substrate 6 and is circumscribed by an annular air permeable diffuser 54 made of, for example, cellulose acetate tow, which is of substantially the same diameter as the aerosol-forming substrate 6 and is circumscribed by filter plug wrap 56.

As shown in FIG. 3, the portion of the open-ended truncated hollow cone 52 that is not circumscribed by the annular air permeable diffuser 54 is circumscribed by an inner wrapper 58 of low air permeability made of, for example, cardboard.

The airflow directing element 8 of the smoking article 50 according to the third embodiment of the invention comprises an aerosol-modifying agent. The aerosol-modifying agent may be applied to one or both of the annular air permeable diffuser 54 and the exterior of the open-ended truncated hollow cone 52 that is not circumscribed by the annular air permeable diffuser 54. Alternatively or in addition, the aerosol-modifying agent may be applied to the interior of the open-ended truncated hollow cone 52.

As also shown in FIG. 3, a circumferential arrangement of air inlets 32 is provided in the outer wrapper 14 and the inner wrapper 58 circumscribing the open-ended truncated hollow cone 52 downstream of the annular air permeable diffuser 54.

An airflow pathway extends between the air inlets 32 and the mouthpiece 12 of the smoking article 50 according to the third embodiment of the invention. The volume bounded by the exterior of the open-ended truncated hollow cone 52 of the airflow directing element 8 and the inner wrapper 56 forms a first portion of the airflow pathway that extends longitudinally from the air inlets 32 to the aerosol-forming substrate 6. The volume bounded by the interior of the hollow cone 52 of the airflow directing element 8 forms a second portion of the airflow pathway that extends downstream towards the mouth piece 12 of the smoking article 50, between the aerosol-forming substrate 6 and the expansion chamber 10.

In use, when a user draws on the mouthpiece 12 of the smoking article 50 according to the third embodiment of the invention, cool air (shown by dotted arrows in FIG. 3) is drawn into the smoking article 50 through the air inlets 32. The drawn air passes to the aerosol-forming substrate 6 along the first portion of the airflow pathway between the exterior of the open-ended truncated hollow cone 52 of the airflow directing element 8 and the inner wrapper 56 and through the annular air permeable diffuser 54.

The front portion 6*a* of the aerosol-forming substrate 6 of the smoking article 50 according to the third embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 3) pass downstream along the second portion of the airflow pathway through the interior of the open-ended truncated hollow cone 52 of the airflow directing element 8 to the expansion chamber 10, where they cool and condense. The cooled aerosol then passes downstream through the mouthpiece 12 of the smoking article 50 according to the third embodiment of the invention into the mouth of the user.

As the drawn air passes between the exterior of the open-ended truncated hollow cone 52 of the airflow directing element 8 and the inner wrapper 56 and through the annular air permeable diffuser 54 and downstream through the interior of the open-ended truncated hollow cone 52 of the airflow directing element 8, the aerosol-modifying agent loaded on the airflow directing element 8 is also entrained in the drawn air and mixes with the volatile and semi-volatile compounds and glycerine released aerosol-forming substrate 6. To increase the level of aerosol-modifying agent in the aerosol delivered to the user, one or both of the aerosol-forming substrate 6 and mouthpiece 12 of the smoking article 50 may also comprise the aerosol-modifying agent.

The non-combustible, substantially air impermeable, barrier coating 20 provided on the rear face of the combustible carbonaceous heat source 4 isolates the combustible carbonaceous heat source 4 from the airflow pathway through the smoking article 50 such that, in use, air drawn through the smoking article 50 along the first portion and the second portion of the airflow pathway does not directly contact the combustible carbonaceous heat source 4.

Figure 4:
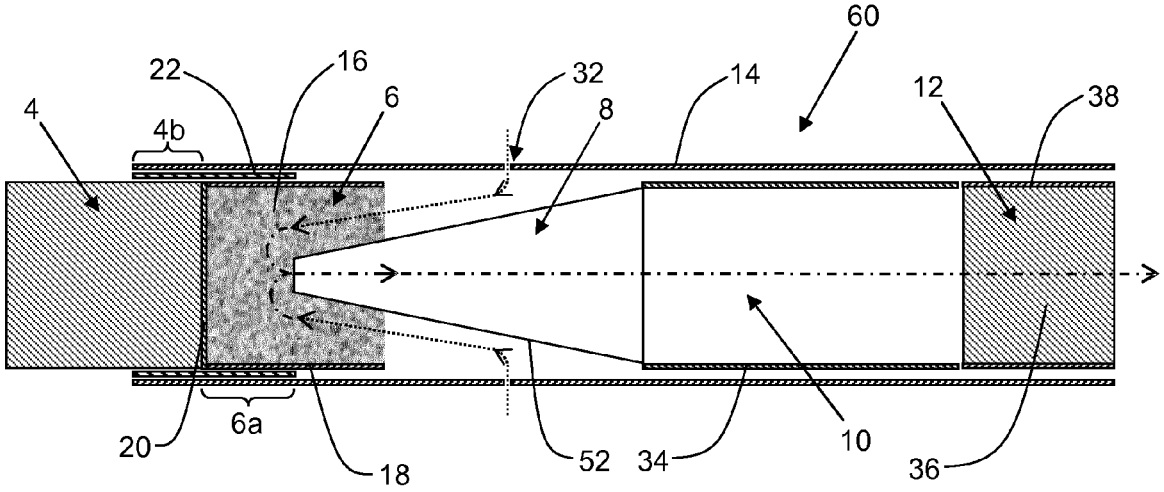
FIG. 4 shows a schematic longitudinal cross-section of a smoking article according to a fourth embodiment of the invention.

As shown in FIG. 4, the smoking article 60 according to the fourth embodiment of the invention differs from the smoking article 50 according to the third embodiment of the invention shown in FIG. 3 in that the upstream end of the open-ended, substantially air impermeable, truncated hollow cone 52 of the airflow directing element 8 extends into the aerosol-forming substrate 6 and is not circumscribed by an annular air permeable diffuser 54. The smoking article 60 according to the fourth embodiment of the invention further differs from the smoking article 50 according to the third embodiment of the invention shown in FIG. 3 in that the substantially air impermeable, truncated hollow cone 52 is not circumscribed by an inner wrapper 58.

The airflow directing element 8 of the smoking article 60 according to the fourth embodiment of the invention comprises an aerosol-modifying agent. The aerosol-modifying agent may be applied to the exterior of the open-ended truncated hollow cone 52. Alternatively or in addition, the aerosol-modifying agent may be applied to the interior of the open-ended truncated hollow cone 52.

In use, when a user draws on the mouthpiece 12 of the smoking article 60 according to the fourth embodiment of the invention, cool air (shown by dotted arrows in FIG. 4) is drawn into the smoking article 60 through the air inlets 32. The drawn air passes to the aerosol-forming substrate 6 along the first portion of the airflow pathway between the exterior of the open-ended truncated hollow cone 52 of the airflow directing element 8 and the outer wrapper 14.

The front portion 6*a* of the aerosol-forming substrate 6 of the smoking article 60 according to the fourth embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug of tobacco material 16, which form an aerosol that is entrained in the drawn air as it flows through the aerosol-forming substrate 6. The drawn air and entrained aerosol (shown by dashed and dotted arrows in FIG. 4) pass downstream along the second portion of the airflow pathway through the interior of the open-ended truncated hollow cone 52 of the airflow directing element 8 to the expansion chamber 10, where they cool and condense. The cooled aerosol then passes downstream through the mouthpiece 12 of the smoking article 60 according to the fourth embodiment of the invention into the mouth of the user.

As the drawn air passes between the exterior of the open-ended truncated hollow cone 52 of the airflow directing element 8 and the outer wrapper 14 and downstream through the interior of the open-ended truncated hollow cone 52 of the airflow directing element 8, the aerosol-modifying agent loaded on the airflow directing element 8 is also entrained in the drawn air and mixes with the volatile and semi-volatile compounds and glycerine released aerosol-forming substrate 6. To increase the level of aerosol-modifying agent in the aerosol delivered to the user, one or more of the aerosol-forming substrate 6, the expansion chamber 10 and the mouthpiece 12 of the smoking article 60 may also comprise the aerosol-modifying agent.

The non-combustible, substantially air impermeable, barrier coating 20 provided on the rear face of the combustible carbonaceous heat source 4 isolates the combustible carbonaceous heat source 4 from the airflow pathway such that, in use, air drawn through the smoking article 60 along the first portion and the second portion of the airflow pathway does not directly contact the combustible carbonaceous heat source 4.

Figure 5:
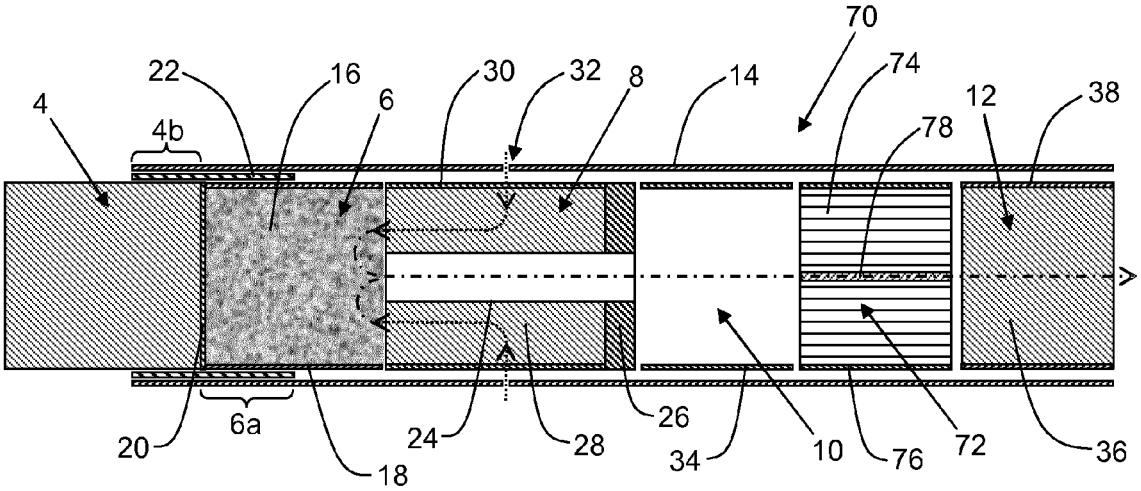
FIG. 5 shows a schematic longitudinal cross-section of a smoking article according to a fifth embodiment of the invention.

The smoking article 70 according to the fifth embodiment of the invention shown in FIG. 5 is of similar construction to the smoking article according to the first embodiment of the invention shown in FIG. 1; the same reference numerals are used in FIG. 5 for parts of the smoking article 70 according to the fifth embodiment of the invention corresponding to parts of the smoking article 2 according to the first embodiment of the invention shown in FIG. 1 and described above.

As shown in FIG. 5, the smoking article 70 according to the fifth embodiment of the invention differs from the smoking article 2 according to the first embodiment of the invention shown in FIG. 1 in that an aerosol-cooling element 72 is provided between the expansion chamber 10 and the mouthpiece 12.

The aerosol-cooling element 72 comprises a gathered, crimped sheet of biodegradable material 74 made of, for example, polylactic acid (PLA), circumscribed by filter plug wrap 76. As shown in FIG. 5, the gathered, crimped sheet of biodegradable material 74 defines a plurality of longitudinally extending channels that extend along the length of the aerosol-cooling element 72. The aerosol-cooling element further comprises an elongate non-laminar fibrous substrate 78. As shown in FIG. 5, the non-laminar fibrous substrate 78 is centrally located in a longitudinally extending channel of the aerosol-cooling element 72 with the longitudinal axis of the non-laminar fibrous substrate 78 disposed substantially parallel to the longitudinal axis of the smoking article 70. The elongate non-laminar fibrous substrate 78 comprises the same aerosol-modifying agent as the airflow directing element 8.

In use, when a user draws on the mouthpiece 12 of the smoking article 70 according to the fifth embodiment of the invention, cool air (shown by dotted arrows in FIG. 5) is drawn into the smoking article 70 through the air inlets 32 and the inner wrapper 30. The drawn air passes to the aerosol-forming substrate 6 along the first portion of the airflow pathway between the exterior of the open-ended hollow tube 24 of the airflow directing element 8 and the inner wrapper 30 and through the annular air permeable diffuser 28.

The front portion 6*a* of the aerosol-forming substrate 6 is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 5) pass downstream along the second portion of the airflow pathway through the interior of the open-ended hollow tube 24 of the airflow directing element 8 to the expansion chamber 10, where they cool and condense. The cooled aerosol then passes downstream through the aerosol-cooling element 72 and the mouthpiece 12 of the smoking article 2 according to the fifth embodiment of the invention into the mouth of the user. As the aerosol passes through the plurality of longitudinally extending channels of the aerosol-cooling element 72, the temperature of the aerosol is further reduced due to transfer of thermal energy to the gathered, crimped sheet of biodegradable material 74 of the aerosol-cooling element 72.

As the drawn air passes between the exterior of the open-ended hollow tube 24 of the airflow directing element 8 and the inner wrapper 30 and through the annular air permeable diffuser 28 and downstream through the interior of the open-ended hollow tube 24 of the airflow directing element 8, the aerosol-modifying agent loaded on the airflow directing element 8 is also entrained in the drawn air and mixes with the volatile and semi-volatile compounds and glycerine released aerosol-forming substrate 6. As the aerosol passes downstream through the aerosol-cooling element 72 the aerosol-modifying agent loaded on the elongate non-fibrous substrate 76 the aerosol-cooling element 72 is also entrained in the drawn air, thereby increasing the level of aerosol-modifying agent in the aerosol delivered to the user.

To further increase the level of aerosol-modifying agent in the aerosol delivered to the user, one or more of the aerosol-forming substrate 6, the expansion chamber 10 and the mouthpiece 12 of the smoking article 2 may also comprise the aerosol-modifying agent.

It will be appreciated that smoking articles according to further embodiments of the invention (not shown) of similar construction to the smoking articles according to the second, third and fourth embodiments of the invention shown in FIGS. 2, 3 and 4, respectively, may also be produced in which an aerosol-cooling element 72 is provided between the expansion chamber 10 and the mouthpiece 12 of the smoking article.

It will also be appreciated that smoking articles according to further embodiments of the invention (not shown) of similar construction to the smoking articles according to the first, second, third and fourth embodiments of the invention shown in FIGS. 1, 2, 3 and 4, respectively, may also be produced in which the expansion chamber 10 is omitted and an aerosol-cooling element 72 is provided between the aerosol-directing element 8 and the mouthpiece 12 of the smoking article.

Figure 6:
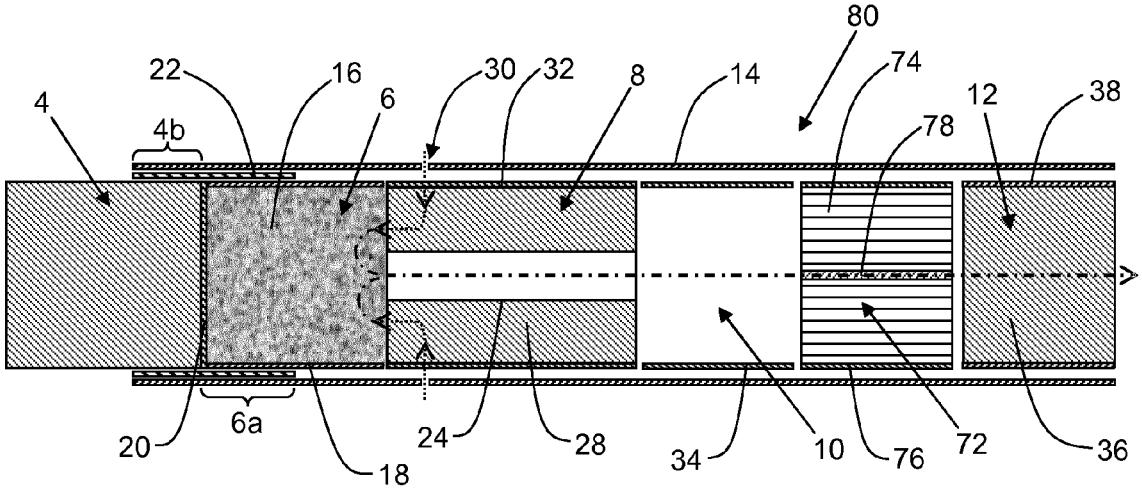
FIG. 6 shows a schematic longitudinal cross-section of a smoking article according to a sixth embodiment of the invention.

The smoking article 80 according to the sixth embodiment of the invention shown in FIG. 6 is of similar construction to the smoking article according to the fifth embodiment of the invention shown in FIG. 5; the same reference numerals are used in FIG. 6 for parts of the smoking article 80 according to the sixth embodiment of the invention corresponding to parts of the smoking article 70 according to the fifth embodiment of the invention shown in FIG. 5 and described above.

As shown in FIG. 6, the construction of the airflow directing element 8 of the smoking article 80 according to the sixth embodiment of the invention differs from that of the airflow directing element 8 of the smoking article according to the fifth embodiment of the invention shown in FIG. 5. In the sixth embodiment of the invention, the airflow directing element 8 does not comprise an annular substantially air impermeable seal 26 of substantially the same diameter as the aerosol-forming substrate 6 surrounding the downstream end of the open-ended hollow tube 24.

As also shown in FIG. 6, in the smoking article 80 according to the sixth embodiment of the invention the circumferential arrangement of air inlets 32 provided in the outer wrapper 14 circumscribing the inner wrapper 30 of the annular air permeable diffuser 28 are located proximate the upstream end of the annular air permeable diffuser 28. In the embodiment exemplified in FIG. 6, the air inlets 32 are located about 3 mm from the upstream end of the air permeable diffuser 28 and the total length of the air permeable diffuser 28 is about 28 mm. This results in the ratio of the resistance-to-draw of a first portion of the air permeable diffuser 28 between the air inlets 32 and the downstream end of the air permeable diffuser and the resistance-to-draw of a second portion of the air permeable diffuser 28 between the air inlets 32 and the upstream end of the air permeable diffuser being about 10:1.

In use, when a user draws on the mouthpiece 12 of the smoking article 80 according to the sixth embodiment of the invention, cool air (shown by dotted arrows in FIG. 6) is drawn into the smoking article 80 through the air inlets 32 and the inner wrapper 30. Due to the lower resistance-to-draw of the second portion of the air permeable diffuser 28, the drawn air passes to the aerosol-forming substrate 6 along the first portion of the airflow pathway between the exterior of the open-ended hollow tube 24 of the airflow directing element 8 and the inner wrapper 30, through the second portion of the air permeable diffuser 28.

It will be appreciated that smoking articles according to further embodiments of the invention (not shown) of similar construction to the smoking articles according to the first embodiment of the invention shown in FIG. 1 may be similarly produced in which the annular substantially air impermeable seal 26 of the airflow-directing element is omitted.

Figure 7:
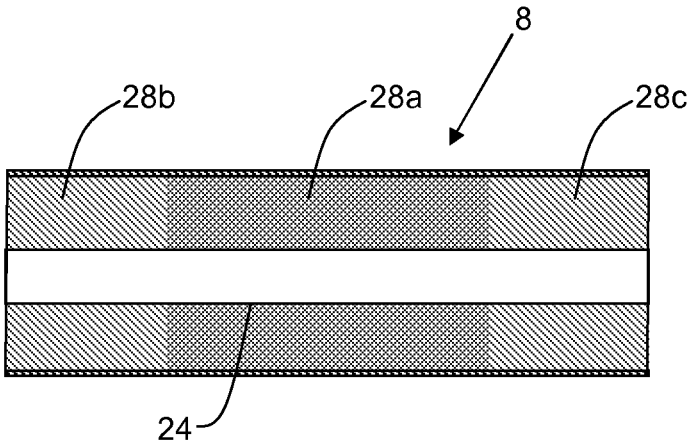
FIG. 7 shows a schematic longitudinal cross-section of the airflow directing element of a smoking article according to a seventh embodiment of the invention.

A smoking article according to a seventh embodiment of the invention is of similar construction to the smoking article according to the sixth embodiment of the invention shown in FIG. 6. The construction of the airflow directing element 8 of the smoking article according to the seventh embodiment of the invention differs from that of the airflow directing element 8 of the smoking article according to the sixth embodiment of the invention shown in FIG. 6. As shown in FIG. 7, in the seventh embodiment of the invention the annular air permeable diffuser 28 of the airflow directing element 8 comprises a first portion 28*a*, a second portion 28*b* upstream of the first portion 28*a*, and a third portion 28*c* downstream of the first portion 28*a*. The resistance-to-draw of the second portion 28*b* of the air permeable diffuser 28 is substantially the same as the resistance-to-draw of the third portion 28*c* of the air permeable diffuser 28. The resistance-to-draw of the first portion 28*a* of the air permeable diffuser 28 is higher than the resistance-to-draw of the second portion 28*b* and the resistance-to-draw of the third portion 28*c* of the air permeable diffuser 28.

In the smoking article according to the seventh embodiment of the invention the circumferential arrangement of air inlets 32 provided in the outer wrapper 14 circumscribing the inner wrapper 30 of the annular air permeable diffuser 28 are located proximate the interface between the first portion 28*a* of the air permeable diffuser 28 and the second portion 28*b* of the air permeable diffuser 28. The ratio of the combined resistance-to-draw of the first portion 28*a* and the third portion 28*c* of the air permeable diffuser 28 and the resistance-to-draw of the second portion 28*b* of the air permeable diffuser is about 10:1.

Smoking articles according to the first, second and third embodiments of the invention shown in FIGS. 1, 2 and 3 are assembled having the dimensions shown in Table 1.

EXAMPLES

Smoking articles according to the fifth embodiment of the invention shown in FIG. 5 are assembled having the dimensions and properties shown in Table 2 in which: (a) the aerosol-forming substrate 6, the airflow-directing element 8, the aerosol-cooling element 72 and the mouthpiece 12 comprise menthol; and (b) the airflow-directing element 8, the aerosol-cooling element 72 and the mouthpiece 12 comprise menthol.

For comparison, smoking articles not according to the invention of identical construction are prepared in which: (c) the aerosol-forming substrate 6, the aerosol-cooling element 72 and the mouthpiece 12 comprise menthol.

In (a) and (b) menthol is applied to the annular air permeable diffuser 28 of the airflow-directing element 8.

In (a) and (c) menthol is sprayed onto the tobacco material used to form the cylindrical plug 16 of tobacco material of the aerosol-forming substrate 6.

In (a), (b) and (c) menthol is also applied to the elongate non-laminar fibrous substrate 78 centrally located in the aerosol-cooling element 72 and injected onto the cellulose acetate tow used to form the cylindrical plug 36 of cellulose acetate tow of the mouthpiece 12.

The smoking articles are packaged in a container with a metallised paper inner liner comprising menthol and left to equilibrate for: (i) 3 weeks; and (ii) 4 weeks. The menthol is sprayed onto the metallised paper inner liner prior to wrapping the smoking articles in the inner liner. After equilibration, the combustible carbonaceous heat sources 4 are ignited using a lighter (15 seconds lighter pre-heating, 6 seconds heating and 10 second delay before first puff). The smoking articles are then smoked under a Health Canada smoking regime (15 puffs) and the menthol in aerosol delivery measured by gas chromatography (GC) using a flame ionization detector (FID). The results are shown in Table 3.

TABLE 1

| | First embodiment | Second embodiment | Third embodiment |
|---|---|---|---|
| Smoking article | | | |
| Overall length (mm) | 84 | 84 | 84 |
| Diameter (mm) | 7.8 | 7.8 | 7.8 |

TABLE 1-continued

| | First embodiment | Second embodiment | Third embodiment |
|---|---|---|---|
| Porous carbonaceous heat source | | | |
| Length (mm) | 8 | 8 | 8 |
| Diameter (mm) | 7.8 | 7.8 | 7.8 |
| Thickness of barrier coating (microns) | ≤500 | ≤500 | ≤500 |
| Aerosol-forming substrate | | | |
| Length (mm) | 10 | 10 | 10 |
| Diameter (mm) | 7.8 | 7.8 | 7.8 |
| Density (g/cm$^3$) | 0.73 | 0.73 | 0.73 |
| Aerosol former | Glycerine | Glycerine | Glycerine |
| Amount of aerosol former | 20% by dry wt. of tobacco | 20% by dry wt. of tobacco | 20% by dry wt. of tobacco |
| Airflow directing element | | | |
| Length (mm) | 26 | 26 | 18 |
| Diameter (mm) | 7.8 | 7.8 | 7.8 |
| Length of air permeable plug (mm) | 24 | — | 5 |
| Diameter of hollow tube (mm) | 3.5 | 3.5 | — |
| Length of hollow tube (mm) | 26 | 31 | — |
| Length of hollow tube extending in aerosol-forming substrate (mm) | — | 5 | — |
| Number of air inlets | 4-8 | 4-8 | 4-8 |
| Diameter of air inlets (mm) | 0.2 | 0.2 | 0.2 |
| Distance of air inlets from distal end (mm) | 24 | 29 | 27 |
| Expansion chamber | | | |
| Length (mm) | 33 | 33 | 41 |
| Diameter (mm) | 7.8 | 7.8 | 7.8 |
| Mouthpiece | | | |
| Length (mm) | 7 | 7 | 7 |
| Diameter (mm) | 7.8 | 7.8 | 7.8 |
| Heat-conducting element | | | |
| Length (mm) | 8 | 8 | 7 |
| Diameter (mm) | 7.8 | 7.8 | 7.8 |
| Thickness of aluminium foil (microns) | 20 | 20 | 20 |
| Length of rear portion of combustible carbonaceous heat source (mm) | 4 | 4 | 3 |
| Length of front portion of aerosol-forming substrate (mm) | 4 | 4 | 4 |
| Length of rear portion of aerosol-forming substrate (mm) | 6 | 6 | 6 |

TABLE 2

| | Example (a) | Example (b) | Comparative Example (c) |
|---|---|---|---|
| Smoking article | | | |
| Overall length (mm) | 85 | 85 | 85 |
| Diameter (mm) | 7.8 | 7.8 | 7.8 |
| Porous carbonaceous heat source | | | |
| Length (mm) | 9 | 9 | 9 |
| Diameter (mm) | 7.8 | 7.8 | 7.8 |
| Thickness of barrier coating (microns) | ≤500 | ≤500 | ≤500 |
| Aerosol-forming substrate | | | |
| Length (mm) | 8 | 8 | 8 |
| Diameter (mm) | 7.8 | 7.8 | 7.8 |
| Density (g/cm$^3$) | 0.73 | 0.73 | 0.73 |

TABLE 2-continued

| | Example (a) | Example (b) | Comparative Example (c) |
|---|---|---|---|
| Aerosol former | Glycerine | Glycerine | Glycerine |
| Amount of aerosol former | 20% by dry wt. of tobacco | 20% by dry wt. of tobacco | 20% by dry wt. of tobacco |
| Amount of menthol (mg) | 3.74 | 0 | 3.74 |
| Airflow directing element | | | |
| Length (mm) | 26 | 26 | 18 |
| Diameter (mm) | 7.8 | 7.8 | 7.8 |
| Length of air permeable plug (mm) | 24 | — | 5 |
| Diameter of hollow tube (mm) | 3.5 | 3.5 | — |
| Length of hollow tube (mm) | 26 | 31 | — |
| Length of hollow tube extending in aerosol-forming substrate (mm) | — | 5 | — |
| Number of air inlets | 4-8 | 4-8 | 4-8 |
| Diameter of air inlets (mm) | 0.2 | 0.2 | 0.2 |
| Distance of air inlets from distal end (mm) | 24 | 29 | 27 |
| Amount of menthol (mg) | 6.24 | 6.24 | 0 |
| Expansion chamber | | | |
| Length (mm) | 33 | 33 | 41 |
| Diameter (mm) | 7.8 | 7.8 | 7.8 |
| Aerosol-cooling element | | | |
| Length (mm) | 10 | 10 | 10 |
| Diameter (mm) | 7.8 | 7.8 | 7.8 |
| Amount of menthol (mg) | 5.18 | 5.18 | 5.18 |
| Mouthpiece | | | |
| Length (mm) | 7 | 7 | 7 |
| Diameter (mm) | 7.8 | 7.8 | 7.8 |
| Amount of menthol (mg) | 3.36 | 3.36 | 3.36 |
| Heat-conducting element | | | |
| Length (mm) | 8 | 8 | 7 |
| Diameter (mm) | 7.8 | 7.8 | 7.8 |
| Thickness of aluminium foil (microns) | 20 | 20 | 20 |
| Length of rear portion of combustible carbonaceous heat source (mm) | 4 | 4 | 3 |
| Length of front portion of aerosol-forming substrate (mm) | 4 | 4 | 4 |
| Length of rear portion of aerosol-forming substrate (mm) | 6 | 6 | 6 |
| Inner Liner | | | |
| Amount of menthol (mg per smoking article) | 3.9 | 3.9 | 3.9 |

TABLE 3

| Menthol in aerosol delivery | Example (a) | Example (b) | Comparative Example (c) |
|---|---|---|---|
| (i) After 3 weeks equilibration | 1.37 | 0.95 | 1.05 |
| (ii) After 4 weeks equilibration | 1.53 | 1.23 | 1.06 |

The embodiments and examples described above illustrate but do not limit the invention. It will be appreciated that other embodiments of the invention may be made and it is to be understood that the specific embodiments described herein are not intended to be limiting.

The invention claimed is:

1. A smoking article having a mouth end and a distal end, the smoking article comprising:

a cylindrical combustible carbonaceous heat source having a front face and an opposed rear face;

an aerosol-forming substrate;

at least one air inlet downstream of the aerosol-forming substrate;

an airflow pathway extending between the at least one air inlet and the mouth end of the smoking article; and an airflow directing element downstream of the aerosol-forming substrate, the airflow directing element defining a first portion of the airflow pathway extending from the at least one air inlet towards the aerosol-forming substrate and a second portion of the airflow pathway extending downstream from the aerosol-forming substrate towards the mouth end of the smoking article, wherein the airflow directing element comprises an aerosol-modifying agent.

2. The smoking article according to claim 1, wherein the airflow directing element comprises a flavourant.

3. The smoking article according to claim 2, wherein the airflow directing element comprises menthol.

4. The smoking article according to claim 1, wherein the aerosol-modifying agent is located along the first portion of the airflow pathway.

5. The smoking article according to claim 1, wherein the aerosol-modifying agent is located along the second portion of the airflow pathway.

6. The smoking article according to claim 1, wherein the first portion of the airflow pathway extends from the at least one air inlet to the aerosol-forming substrate and the second portion of the airflow pathway extends downstream from the aerosol-forming substrate towards the mouth end of the smoking article.

7. The smoking article according to claim 1, wherein the first portion of the airflow pathway extends from the at least one air inlet to the aerosol-forming substrate and the second portion of the airflow pathway extends downstream from within the aerosol-forming substrate towards the mouth end of the smoking article.

8. The smoking article according to claim 1, wherein the first portion of the airflow pathway and the second portion of the airflow pathway are concentric.

9. The smoking article according to claim 1, wherein the first portion of the airflow pathway surrounds the second portion of the airflow pathway.

10. The smoking article according to claim 1, wherein the airflow directing element comprises an open-ended, substantially air impermeable hollow body.

11. The smoking article according to claim 10, wherein the second portion of the airflow pathway is defined by the volume bounded by the interior of the open-ended, substantially air impermeable hollow body.

12. The smoking article according to claim 10 , wherein the airflow directing element further comprises an air permeable diffuser circumscribing at least a portion of the open-ended, substantially air impermeable hollow body.

13. The smoking article according to claim 12, wherein the air permeable diffuser comprises the aerosol-modifying agent.

14. The smoking article according to claim 13, wherein the air permeable diffuser comprises a low resistance-to-draw portion extending from proximate to the at least one air inlet to an upstream end of the air permeable diffuser and a high resistance-to-draw portion extending from proximate to the at least one air inlet to a downstream end of the air permeable diffuser wherein the first portion of the airflow pathway is defined by the low resistance-to-draw portion of the air permeable diffuser.

15. The smoking article according to claim 10, wherein the hollow body is a right circular cylinder.

16. The smoking article according to claim 10, wherein the hollow body is a truncated right circular cone.

* * * * *